US009411284B2

(12) United States Patent
Waida et al.

(10) Patent No.: US 9,411,284 B2
(45) Date of Patent: Aug. 9, 2016

(54) FIXING DEVICE

(71) Applicants: Takumi Waida, Tokyo (JP); Hiroshi Seo, Kanagawa (JP); Ippei Fujimoto, Kanagawa (JP); Ryota Yamashina, Kanagawa (JP)

(72) Inventors: Takumi Waida, Tokyo (JP); Hiroshi Seo, Kanagawa (JP); Ippei Fujimoto, Kanagawa (JP); Ryota Yamashina, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 13/761,848

(22) Filed: Feb. 7, 2013

(65) Prior Publication Data

US 2013/0209123 A1 Aug. 15, 2013

(30) Foreign Application Priority Data

Feb. 9, 2012 (JP) ..... 2012-026040
Jun. 11, 2012 (JP) ..... 2012-131730

(51) Int. Cl.
*G03G 15/20* (2006.01)

(52) U.S. Cl.
CPC ..... *G03G 15/2078* (2013.01); *G03G 15/205* (2013.01); *G03G 15/2039* (2013.01); *G03G 2215/00603* (2013.01); *G03G 2215/2029* (2013.01)

(58) Field of Classification Search
CPC ..... G03G 15/2039; G03G 15/2078; G03G 2215/00603
USPC ..... 399/67, 68
See application file for complete search history.

(56) References Cited

U.S. PATENT DOCUMENTS

| | | | | |
|---|---|---|---|---|
| 5,109,255 | A * | 4/1992 | Nishikawa et al. | 399/70 |
| 5,682,576 | A * | 10/1997 | Sakai et al. | 399/69 |
| 5,991,563 | A * | 11/1999 | Haneda et al. | 399/68 |
| 6,246,843 | B1 * | 6/2001 | Nanataki et al. | 399/45 |
| 2006/0002745 | A1 | 1/2006 | Iwasaki | |
| 2006/0165443 | A1 | 7/2006 | Yoshinaga et al. | |

(Continued)

FOREIGN PATENT DOCUMENTS

| | | |
|---|---|---|
| JP | 8-095422 | 4/1996 |
| JP | 11-133791 | 5/1999 |

(Continued)

OTHER PUBLICATIONS

U.S. Appl. No. 13/716,651, filed Dec. 17, 2012, Saito.

(Continued)

*Primary Examiner* — Benjamin Schmitt
(74) *Attorney, Agent, or Firm* — Oblon, McClelland, Maier & Neustadt, L.L.P.

(57) ABSTRACT

A fixing device includes a rotatable fuser member, a rotatable pressure member, a heater, and a controller. The rotatable fuser member is subjected to heating. The rotatable pressure member is disposed opposite the fuser member. The pressure member presses against the fuser member to form a fixing nip therebetween, through which multiple recording media, each spaced apart from each other by an interval distance in a conveyance direction, are sequentially conveyed at a conveyance speed. The heater is disposed adjacent to the fuser member to heat the fuser member. The controller is operatively connected to the heater to control power supply to the heater through a series of on-off switching control cycles, each including an on-time during which the heater power supply is on, and an off-time during which the heater power supply is off, in synchronization with conveyance of the recording medium.

23 Claims, 11 Drawing Sheets

(56) References Cited

U.S. PATENT DOCUMENTS

| | | | |
|---|---|---|---|
| 2006/0177232 | A1 | 8/2006 | Ehara et al. |
| 2007/0003334 | A1 | 1/2007 | Shinshi et al. |
| 2007/0059003 | A1 | 3/2007 | Shinshi et al. |
| 2007/0059011 | A1 | 3/2007 | Seo et al. |
| 2007/0212089 | A1 | 9/2007 | Seo et al. |
| 2007/0242988 | A1 | 10/2007 | Seo et al. |
| 2007/0280754 | A1 | 12/2007 | Ogawa et al. |
| 2008/0025772 | A1 | 1/2008 | Seo et al. |
| 2008/0025773 | A1 | 1/2008 | Ito et al. |
| 2008/0044196 | A1 | 2/2008 | Seo et al. |
| 2008/0219721 | A1 | 9/2008 | Ito et al. |
| 2008/0226326 | A1 | 9/2008 | Seo et al. |
| 2008/0232873 | A1 | 9/2008 | Ueno et al. |
| 2008/0253789 | A1 | 10/2008 | Yoshinaga et al. |
| 2009/0003867 | A1 | 1/2009 | Fujimoto |
| 2009/0060550 | A1 | 3/2009 | Seo |
| 2009/0148205 | A1 | 6/2009 | Seo et al. |
| 2009/0169232 | A1 | 7/2009 | Kunii et al. |
| 2009/0245897 | A1 | 10/2009 | Seo et al. |
| 2010/0061754 | A1 | 3/2010 | Ishigaya et al. |
| 2010/0092220 | A1 | 4/2010 | Hasegawa et al. |
| 2010/0092221 | A1 | 4/2010 | Shinshi et al. |
| 2010/0290822 | A1 | 11/2010 | Hasegawa et al. |
| 2010/0303521 | A1 | 12/2010 | Ogawa et al. |
| 2011/0026988 | A1 | 2/2011 | Yoshikawa et al. |
| 2011/0044734 | A1 | 2/2011 | Shimokawa et al. |
| 2011/0052237 | A1 | 3/2011 | Yoshikawa et al. |
| 2011/0052245 | A1 | 3/2011 | Shinshi et al. |
| 2011/0052277 | A1 | 3/2011 | Ueno et al. |
| 2011/0052282 | A1 | 3/2011 | Shinshi et al. |
| 2011/0058862 | A1 | 3/2011 | Yamaguchi et al. |
| 2011/0058863 | A1 | 3/2011 | Shinshi et al. |
| 2011/0058864 | A1 | 3/2011 | Fujimoto et al. |
| 2011/0058865 | A1 | 3/2011 | Tokuda et al. |
| 2011/0058866 | A1 | 3/2011 | Ishii et al. |
| 2011/0064437 | A1 | 3/2011 | Yamashina et al. |
| 2011/0064443 | A1 | 3/2011 | Iwaya et al. |
| 2011/0064450 | A1 | 3/2011 | Ishii et al. |
| 2011/0064490 | A1 | 3/2011 | Imada et al. |
| 2011/0064502 | A1 | 3/2011 | Hase et al. |
| 2011/0076071 | A1 | 3/2011 | Yamaguchi et al. |
| 2011/0085832 | A1 | 4/2011 | Hasegawa et al. |
| 2011/0091226 | A1 | 4/2011 | Ishigaya et al. |
| 2011/0091253 | A1 | 4/2011 | Seo et al. |
| 2011/0116848 | A1 | 5/2011 | Yamaguchi et al. |
| 2011/0129268 | A1 | 6/2011 | Ishii et al. |
| 2011/0150518 | A1 | 6/2011 | Hase et al. |
| 2011/0170917 | A1 | 7/2011 | Yoshikawa et al. |
| 2011/0182634 | A1 | 7/2011 | Ishigaya et al. |
| 2011/0182638 | A1 | 7/2011 | Ishii et al. |
| 2011/0194869 | A1 | 8/2011 | Yoshinaga et al. |
| 2011/0194870 | A1 | 8/2011 | Hase et al. |
| 2011/0200368 | A1 | 8/2011 | Yamaguchi et al. |
| 2011/0200370 | A1 | 8/2011 | Ikebuchi et al. |
| 2011/0206402 | A1 | 8/2011 | Yamashina et al. |
| 2011/0206427 | A1 | 8/2011 | Iwaya et al. |
| 2011/0211876 | A1 | 9/2011 | Iwaya et al. |
| 2011/0217056 | A1 | 9/2011 | Yoshinaga et al. |
| 2011/0217057 | A1 | 9/2011 | Yoshinaga et al. |
| 2011/0217093 | A1 | 9/2011 | Tokuda et al. |
| 2011/0217095 | A1 | 9/2011 | Ishii et al. |
| 2011/0222875 | A1 | 9/2011 | Imada et al. |
| 2011/0222876 | A1 | 9/2011 | Yuasa et al. |
| 2011/0222888 | A1 | 9/2011 | Ikebuchi et al. |
| 2011/0222926 | A1 | 9/2011 | Ueno et al. |
| 2011/0222927 | A1 | 9/2011 | Yamashina et al. |
| 2011/0222929 | A1 | 9/2011 | Fujimoto et al. |
| 2011/0222930 | A1 | 9/2011 | Fujimoto et al. |
| 2011/0222931 | A1 | 9/2011 | Shinshi et al. |
| 2011/0229161 | A1 | 9/2011 | Ueno et al. |
| 2011/0229162 | A1 | 9/2011 | Ogawa et al. |
| 2011/0229178 | A1 | 9/2011 | Ogawa et al. |
| 2011/0229181 | A1 | 9/2011 | Iwaya et al. |
| 2011/0229200 | A1 | 9/2011 | Yamaguchi et al. |
| 2011/0229225 | A1 | 9/2011 | Ishii et al. |
| 2011/0229226 | A1 | 9/2011 | Tokuda et al. |
| 2011/0229227 | A1 | 9/2011 | Yoshikawa et al. |
| 2011/0229228 | A1 | 9/2011 | Yoshikawa et al. |
| 2011/0229236 | A1 | 9/2011 | Ehara et al. |
| 2011/0274453 | A1 | 11/2011 | Shimokawa et al. |
| 2011/0311284 | A1 | 12/2011 | Seo et al. |
| 2012/0051774 | A1 | 3/2012 | Ikebuchi et al. |
| 2012/0093532 | A1 | 4/2012 | Ishigaya et al. |
| 2012/0093534 | A1 | 4/2012 | Waida et al. |
| 2012/0114345 | A1 | 5/2012 | Fujimoto et al. |
| 2012/0121303 | A1 | 5/2012 | Takagi et al. |
| 2012/0121304 | A1 | 5/2012 | Tokuda et al. |
| 2012/0121305 | A1 | 5/2012 | Yoshikawa et al. |
| 2012/0148303 | A1 | 6/2012 | Yamaguchi et al. |
| 2012/0155935 | A1 | 6/2012 | Yoshikawa et al. |
| 2012/0155936 | A1 | 6/2012 | Yamaguchi et al. |
| 2012/0177388 | A1 | 7/2012 | Imada et al. |
| 2012/0177393 | A1 | 7/2012 | Ikebuchi et al. |
| 2012/0177420 | A1 | 7/2012 | Shimokawa et al. |
| 2012/0177423 | A1 | 7/2012 | Imada et al. |
| 2012/0201547 | A1 | 8/2012 | Yamashina et al. |
| 2012/0207502 | A1 | 8/2012 | Seo |
| 2012/0219312 | A1 | 8/2012 | Yuasa et al. |
| 2012/0224878 | A1 | 9/2012 | Ikebuchi et al. |
| 2012/0237273 | A1 | 9/2012 | Yoshinaga et al. |
| 2012/0243895 | A1 | 9/2012 | Samei et al. |
| 2012/0301161 | A1 | 11/2012 | Fujimoto |

FOREIGN PATENT DOCUMENTS

| | | |
|---|---|---|
| JP | 11-202672 | 7/1999 |
| JP | 2002-006673 | 1/2002 |
| JP | 2002-049264 | 2/2002 |
| JP | 2002-304086 | 10/2002 |
| JP | 2003-036000 | 2/2003 |
| JP | 2004-198535 A | 7/2004 |
| JP | 2006-047990 | 2/2006 |
| JP | 2010-286650 | 12/2010 |
| JP | 2011-197155 A | 10/2011 |

OTHER PUBLICATIONS

U.S. Appl. No. 13/749,164, filed Jan. 24, 2013, Waida et al.
U.S. Appl. No. 13/755,439, filed Jan. 31, 2013, Seo et al.
U.S. Appl. No. 13/753,827, filed Jan. 30, 2013, Yamashina et al.

* cited by examiner

FIXING DEVICE

CROSS-REFERENCE TO RELATED APPLICATIONS

The present patent application claims priority pursuant to 35 U.S.C. §119 from Japanese Patent Application Nos. 2012-026040 and 2012-131730, filed on Feb. 9, 2012, and Jun. 11, 2012, respectively, each of which is hereby incorporated by reference herein in its entirety.

BACKGROUND OF THE INVENTION

1. Technical Field

The present invention relates to a fixing device, and more particularly, to a fixing device for use in an image forming apparatus, such as a photocopier, facsimile machine, printer, plotter, or multifunctional machine incorporating several of these features.

2. Background Art

In electrophotographic image forming apparatuses, such as photocopiers, facsimile machines, printers, plotters, or multifunctional machines incorporating several of these features, an image is formed by attracting developer or toner particles to a photoconductive surface for subsequent transfer to a recording medium such as a sheet of paper. After transfer, the imaging process is followed by a fixing process using a fixing device, which permanently fixes the toner image in place on the recording medium with heat and pressure.

In general, a fixing device employed in electrophotographic image formation includes a pair of generally cylindrical looped belts or rollers, one being heated for fusing toner ("fuser member") and the other being pressed against the heated one ("pressure member"), which together form a heated area of contact called a fixing nip. As a recording medium bearing a toner image thereupon enters the fixing nip, heat from the fuser member causes the toner particles to fuse and melt, while pressure between the fuser and pressure members causes the molten toner to set onto the recording medium.

To date, some fixing devices employ a small-sized, thin-walled fixing roller that exhibits an extremely low heat capacity. Although allowing a fast, energy-efficient fixing process that can process a toner image with a short warm-up time and reduced energy consumption, those fixing devices are susceptible to variations in fixing performance due to insufficient heating of the low-heat capacity equipment, from which a substantial amount of heat is dissipated as the recording medium passes through the fixing nip.

To prevent variations in fixing performance, one approach is to design a fuser roller with its circumferential length longer than a shorter edge of a recording sheet accommodated in the fixing device, such as A4-size copy paper. Such arrangement allows the recording sheet to pass through the fixing nip in a shorter period of time than that required for one rotation of the fuser roller, thereby enabling uniform heat distribution from the fuser roller along the length of the recording sheet.

Although generally successful for its intended purposes, the method described above has a limitation in that it cannot effectively prevent variations in fixing performance during sequential processing of multiple recording sheets through the fixing nip, or upon a change in imaging speed measured in terms of number of recording sheets per unit time.

Where heater power supply is controlled independently of conveyance of the recording sheet, a delay or difference in time may arise between when the recording sheet enters the fixing nip and when the heater is activated to heat the fuser member. Such a lack of synchronization between heater activation and entry of the recording sheet into the fixing nip results in variations in the amount of heat applied to the recording sheet, leading to variations in fixing performance.

SUMMARY OF THE INVENTION

Exemplary aspects of the present invention are put forward in view of the above-described circumstances, and provide a novel fixing device.

In one exemplary embodiment, the fixing device includes a rotatable fuser member, a rotatable pressure member, a heater, and a controller. The rotatable fuser member is subjected to heating. The rotatable pressure member is disposed opposite the fuser member. The pressure member presses against the fuser member to form a fixing nip therebetween, through which multiple recording media, each spaced apart from each other by an interval distance in a conveyance direction, are sequentially conveyed at a conveyance speed. The heater is disposed adjacent to the fuser member to heat the fuser member. The controller is operatively connected to the heater to control power supply to the heater through a series of on-off switching control cycles, each including an on-time during which the heater power supply is on, and an off-time during which the heater power supply is off, in synchronization with conveyance of the recording medium to satisfy the following equation:

$$T1+T2=C*X$$

where "T1" is a length of media passage time during which each recording medium passes through the fixing nip, "T2" is a length of interval time between two successive recording media exiting and subsequently entering the fixing nip, "C" is a duration of the control cycle of the heater power supply, and "X" is a cycle count being a positive integer. The controller resets timing of at least one of the series of control cycles, such that the heater is activated simultaneously with entry of the recording medium into the fixing nip.

Other exemplary aspects of the present invention are put forward in view of the above-described circumstances, and provide a novel image forming apparatus incorporating the fixing device.

BRIEF DESCRIPTION OF THE DRAWINGS

A more complete appreciation of the disclosure and many of the attendant advantages thereof will be readily obtained as the same becomes better understood by reference to the following detailed description when considered in connection with the accompanying drawings, wherein.

DETAILED DESCRIPTION OF PREFERRED EMBODIMENTS

Figure 1A:
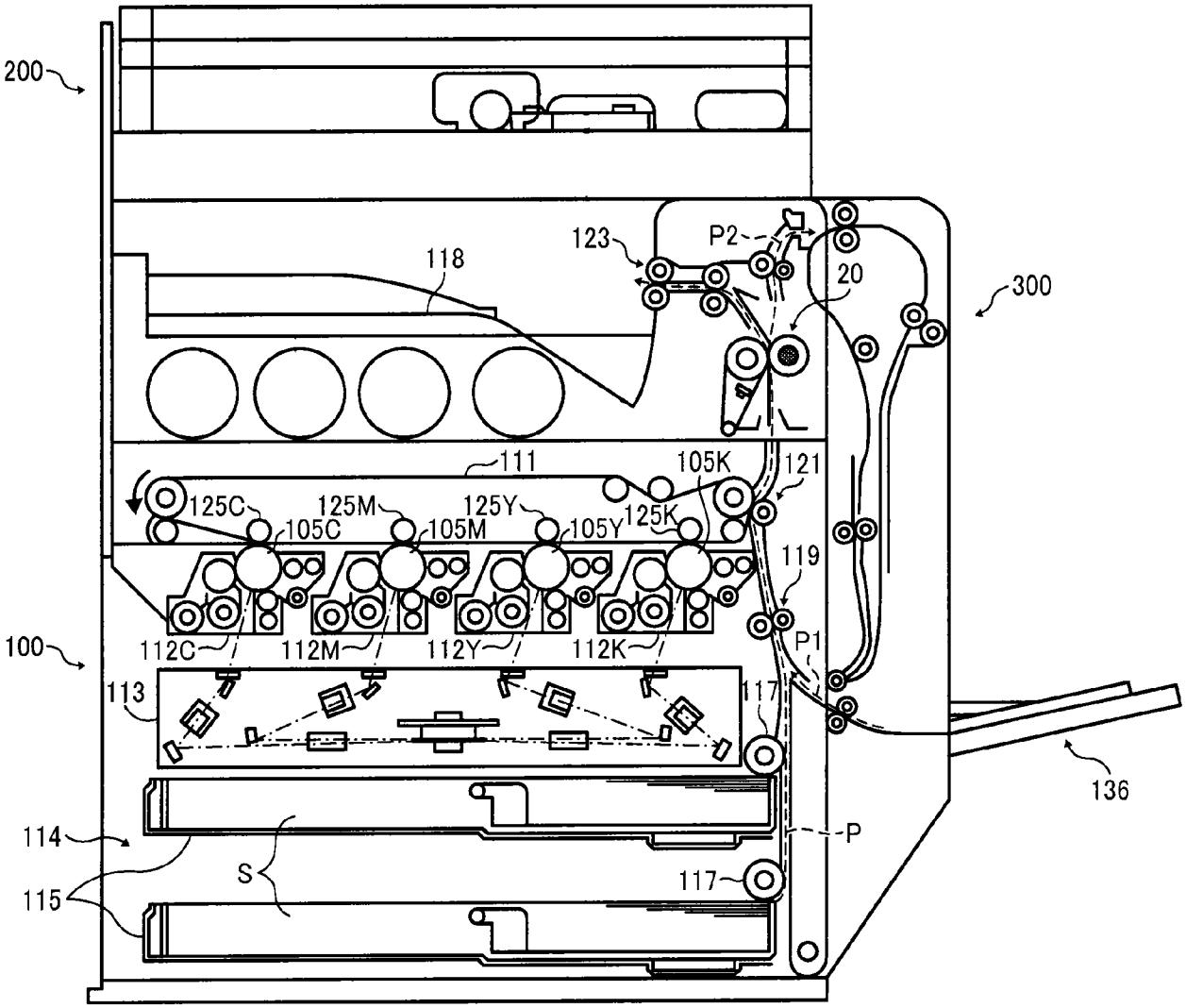
FIGS. 1A and 1B each schematically illustrates an image forming apparatus incorporating a fixing device according to one or more embodiments of this patent specification.

In describing exemplary embodiments illustrated in the drawings, specific terminology is employed for the sake of clarity. However, the disclosure of this patent specification is not intended to be limited to the specific terminology so selected, and it is to be understood that each specific element includes all technical equivalents that operate in a similar manner and achieve a similar result.

Referring now to the drawings, wherein like reference numerals designate identical or corresponding parts throughout the several views, exemplary embodiments of the present patent application are described.

Figure 1B:
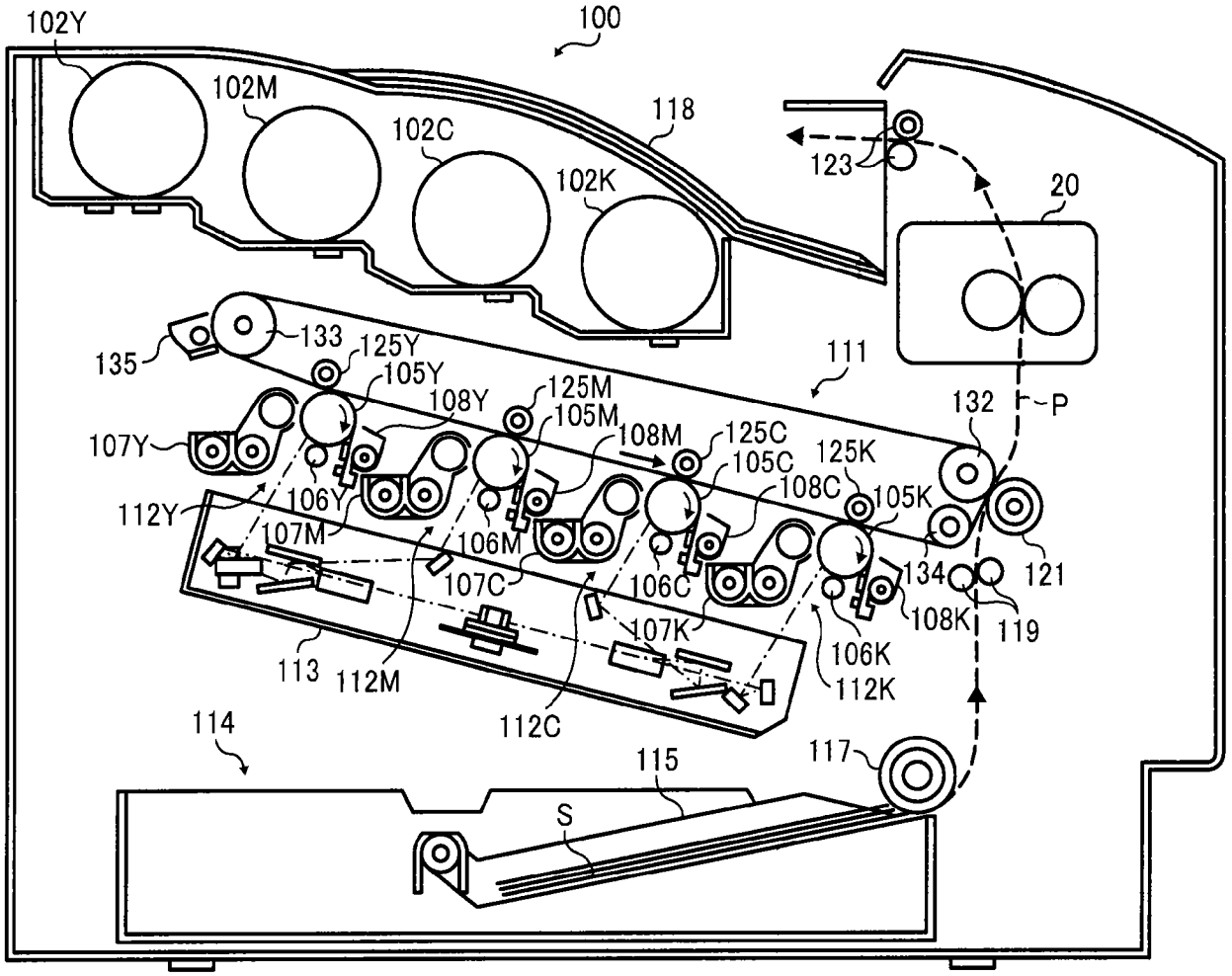

FIGS. 1A and 1B each schematically illustrates an image forming apparatus 100 incorporating a fixing device 20 according to one or more embodiments of this patent specification.

As shown in FIGS. 1A and 1B, the fixing device 20 is applicable to various types of image forming apparatus, such as a photocopier, facsimile machine, printer, plotter, or multifunctional machine incorporating several of these features, which can reproduce a color image on a recording medium S according to image data. Various types of recording medium S may be used for electrophotographic image formation, including, but are not limited to, normal copy paper, cardboard, postcard, envelope, tissue paper, coated paper, enamel paper, art paper, tracing paper, and transparency for overhead projection (OHP).

With specific reference to FIG. 1A, the image forming apparatus 100 is shown configured as an electrophotographic copier provided with an image scanner 200 located atop the apparatus body to capture image data from an original document, as well as a media reversal unit 300 attached to a side of the apparatus body to allow reversing a recording sheet S during duplex printing.

The apparatus 100 comprises a tandem color printer that forms a color image by combining images of yellow, magenta, and cyan (i.e., the complements of three subtractive primary colors) as well as black, consisting of four electrophotographic imaging stations 112C, 112M, 112Y, and 112K arranged in series substantially laterally along the length of an intermediate transfer belt 111, each forming an image with toner particles of a particular primary color, as designated by the suffixes "C" for cyan, "M" for magenta, "Y" for yellow, and "K" for black.

Each imaging station 112 includes a drum-shaped photoconductor 105 rotatable clockwise in the drawing, facing a laser exposure device 113 therebelow, while surrounded by various pieces of imaging equipment, such as a charging device, a development device, a transfer device incorporating an electrically biased, primary transfer roller 125, and a cleaning device for the photoconductive surface, which work in cooperation to form a primary toner image on the photoconductor 105 for subsequent transfer to the intermediate transfer belt 111 at a primary transfer nip defined between the photoconductive drum 105 and the primary transfer roller 125.

The intermediate transfer belt 111 is trained around multiple support rollers to rotate counterclockwise in the drawing, passing through the four primary transfer nips sequentially to carry thereon a multi-color toner image toward a secondary transfer nip defined between a secondary transfer roller 121 and a belt support roller.

Below the exposure device 113 is a sheet supply unit 114 including one or more input sheet trays 115 each accommodating a stack of recording media such as paper sheets S. A feed roller 117 is disposed at one end of each sheet tray 115 to feed the recording sheet S from the sheet stack. The sheet supply unit 114 also includes a pair of registration rollers 119, an output unit formed of a pair of output rollers 123, an in-body, output sheet tray 118 located underneath the image scanner 200, and other guide rollers or plates disposed between the input and output trays 115 and 118.

The sheet supply unit 114 defines a primary, sheet conveyance path P for conveying the recording sheet S from the input tray 115, between the registration rollers 119, then through the secondary transfer nip, then through the fixing device 20, and then between the output rollers 123 to the output tray 118. A pair of secondary, sheet conveyance paths P1 and P2 are also defined in connection with the primary path P, the former for re-introducing a sheet S into the primary path P after processing through the reversal unit 300 or upon input in a manual input tray 136, and the latter for introducing a sheet S from the primary path P into the reversal unit 300 downstream from the fixing device 20.

During operation, the image forming apparatus 100 can perform printing in various print modes, including a monochrome print mode and a full-color print mode, as specified by a user submitting a print job.

In full-color printing, each imaging station 112 rotates the photoconductor drum 105 clockwise in the drawing to forward its outer, photoconductive surface to a series of electrophotographic processes, including charging, exposure, development, transfer, and cleaning, in one rotation of the photoconductor drum 105.

First, the photoconductive surface is uniformly charged by the charging roller and subsequently exposed to a modulated laser beam emitted from the exposure device 113. The laser exposure selectively dissipates the charge on the photoconductive surface to form an electrostatic latent image thereon according to image data representing a particular primary color. Then, the latent image enters the development device, which renders the incoming image visible using toner. The toner image thus obtained is forwarded to the primary transfer nip at which the incoming image is transferred to the intermediate transfer belt 111 with an electrical bias applied to the primary transfer roller 125.

As the multiple imaging stations 112 sequentially produce toner images of different colors at the four transfer nips along the belt travel path, the primary toner images are superimposed one atop another to form a single multicolor image on the moving surface of the intermediate transfer belt 111 for subsequent entry to the secondary transfer nip between the secondary transfer roller 121 and the belt support roller.

Meanwhile, the sheet supply unit 114 picks up the recording sheet S from atop the sheet stack in the sheet tray 115 to introduce it between the pair of registration rollers 119 being rotated. Upon receiving the incoming sheet S, the registration rollers 119 stop rotation to hold the sheet S therebetween, and then advance it in sync with the movement of the intermediate transfer belt 111 to the secondary transfer nip at which the multicolor image is transferred from the belt 111 to the recording sheet S with an electrical bias applied to the secondary transfer roller.

After secondary transfer, the recording sheet S is introduced into the fixing device 20 to fix the toner image in place under heat and pressure. The recording sheet S, thus having its first side printed, is forwarded to a sheet diverter, which directs the incoming sheet S to an output roller pair 123 for output to the in-body output tray 118 along the primary path P when simplex printing is intended, or alternatively, to the media reversal unit 300 along the secondary path P2 when duplex printing is intended.

For duplex printing, the reversal unit 300 turns over the incoming sheet S for reentry to the sheet conveyance path P along the secondary path P1, so that the reversed sheet S again undergoes electrophotographic imaging processes including registration through the registration roller pair 119, secondary transfer through the secondary transfer nip, and fixing through the fixing device 100 to form another print on its second side opposite the first side.

Upon completion of simplex or duplex printing, the recording sheet S is output to the in-body output tray 118 for stacking inside the apparatus body, which completes one operational cycle of the image forming apparatus 100.

With specific reference to FIG. 1B, the image forming apparatus 100 is shown configured as an electrophotographic color laser printer, including four electrophotographic imaging stations 112Y, 112M, 112C, and 112K arranged in series at the middle of the apparatus body, each having a substantially identical configuration, except for the color of toner accommodated therein, as designated by the suffixes "Y" for yellow, "M" for magenta, "C" for cyan, and "K" for black.

Each imaging station 112 includes a drum-shaped photoconductor 105 defining an outer, photoconductive surface on which a toner image is created; a charging roller 106 for uniformly charging the photoconductive surface; a development device 107 for applying toner to the photoconductive surface; and a cleaning blade 108 for cleaning the photoconductive surface, all or part of which are integrated into a single, integral process unit removably installed into the image forming apparatus 100.

Below the imaging stations 112 is an exposure unit 113 for exposing the photoconductive surface with light according to image data, consisting of a light source and various pieces of optical equipment, such as a polygon minor, an f-θ lens, and a reflection mirror, which together generate laser or light beam modulated based on an image signal obtained by decomposing original image data.

Extending above the imaging stations 112 is an image transfer unit, including a looped, intermediate transfer belt 111, and four primary transfer rollers 125Y, 125M, 125C, and 125K disposed inside the loop of the belt 111, as well as a secondary transfer roller 121 and a belt cleaner 135 disposed outside the loop of the belt 111. The belt 111 is entrained around a transfer backup roller 132, a cleaning backup roller 133, and a tension roller 134. A rotary driver is provided to rotate the transfer backup roller 132, which in turn rotates the belt 111 counterclockwise in the drawing.

The four primary transfer rollers 125Y, 125M, 125C, and 125K each presses against an associated one of the photoconductors 105 via the belt 111 to form a primary transfer nip therebetween. An electrical bias applicator is connected to each primary transfer roller 125 to supply a primary electrical bias, such as a direct current (DC) voltage, an alternate current (AC) voltage, or a combination thereof, to the roller 125, such that the toner image is primarily transferred from the photoconductive surface to the intermediate transfer belt 111 through the primary transfer nip.

The secondary transfer roller 121 presses against the transfer backup roller 132 via the belt 111 to form a secondary transfer nip therebetween. An electrical bias applicator is connected to the secondary transfer roller 121 to supply a secondary electrical bias, such as a direct current (DC) voltage, an alternate current (AC) voltage, or a combination thereof, to the roller 121, such that the toner image is secondarily transferred from the intermediate transfer belt 111 to the recording sheet S through the secondary transfer nip.

The belt cleaner 135 includes a combination of a brush and a scraper blade disposed in contact with the intermediate transfer belt 111 downstream from the secondary transfer nip and upstream from the four primary transfer nips to remove toner and other residues from the belt surface after image transfer. The belt cleaner 135 has an outlet connected to a suitable toner conduit or hose, which transfers residual particles from the belt cleaner 135 for collection into a waste toner container.

At an upper portion of the apparatus body is a bottle rack accommodating four replaceable toner bottles 102Y, 102M, 102C, and 102K, containing toner for supply to the imaging units 112Y, 112M, 112C, and 112K, respectively. A toner supply path is provided between each thriller bottle 102 and its associated development device 107, through which fresh toner is supplied as needed by the development process.

At a lower portion of the apparatus body is the sheet supply unit 114, which includes a sheet tray 115 accommodating a stack of recording sheets S. A feed roller 117 is disposed at one end of the sheet tray 115 to feed the recording sheet S from the sheet stack. The sheet supply unit 114 also includes a pair of registration rollers 119, an output unit formed of a pair of output rollers 123, an output sheet tray 118 located atop the apparatus body, and other guide rollers or plates disposed between the input and output trays 115 and 118.

A sheet conveyance path P extends vertically upward from the sheet supply unit 114, for conveying a recording sheet S from the input tray 115, between the registration rollers 119, then through the secondary transfer nip, then through the fixing device 20, and then between the output rollers 123 to the output sheet tray 118.

During operation, each imaging station 112 rotates the photoconductor drum 105 clockwise in the drawing to forward its outer, photoconductive surface to a series of electrophotographic processes, including charging, exposure, development, transfer, and cleaning, in one rotation of the photoconductor drum 105.

First, the photoconductive surface is charged to a given uniform potential by the charging roller 106 and subsequently exposed to a laser beam emitted from the exposure device 113, which is modulated based on an image signal for a particular primary color obtained by decomposing the original image data into primary color components. The laser exposure selectively dissipates the charge on the photoconductive surface to form an electrostatic latent image thereon. Then, the latent image enters the development device 107, which renders the incoming image visible using toner. The toner image thus obtained is forwarded to the primary transfer nip between the primary transfer roller 125 and the photoconductor 105.

In the image transfer unit, the intermediate transfer belt 111 rotates counterclockwise in the drawing. At the primary transfer nip, the primary transfer roller 125 is electrified with a constant, current-controlled or voltage-controlled bias voltage of a potential opposite that of the toner being charged to form a primary transfer field between the photoconductor 105 and the primary transfer roller 125, under which the toner image is transferred from the photoconductor 105 to the intermediate transfer belt 111.

As the multiple imaging stations 112 sequentially produce toner images of different colors at the four transfer nips along the belt travel path, the primary toner images are superimposed one atop another to form a single multicolor image on the moving surface of the intermediate transfer belt 111 for subsequent entry to the secondary transfer nip between the secondary transfer roller 121 and the transfer backup roller 132.

Meanwhile, in the sheet supply unit 114, the feed roller 117 introduces the recording sheet S from the sheet tray 115 into the sheet conveyance path P. Upon entering the sheet conveyance path P, the recording sheet S reaches the pair of registration rollers 119 being rotated, which upon receiving the incoming sheet S, stops rotation to hold the sheet S therebetween, and then advances it in sync with the movement of the intermediate transfer belt 111 to the secondary transfer nip.

At the secondary transfer nip, the secondary transfer roller 121 is electrified with a bias voltage of a potential opposite that of the toner being charged to form a secondary transfer field between the transfer backup roller 132 and the secondary transfer roller 121, under which the multicolor toner image is transferred from the intermediate transfer belt 111 to the recording sheet S. The intermediate transfer belt 111 after exiting the secondary transfer nip reaches the belt cleaner 135, which cleans the belt surface of untransferred, residual toner, followed by the waste toner conduit transferring toner residues from the belt cleaner 135 to the waste toner container.

After secondary transfer, the recording sheet S is advanced to the fixing device 20 to fix the toner image in place under heat and pressure. Thereafter, the output roller pair 123 outputs the recording sheet S to the output tray 118 for stacking outside the apparatus body, which completes one operational cycle of the image forming apparatus 100.

Although the embodiment above describes an operation in which the image forming apparatus 100 reproduces a full-color image using all the four color imaging stations 112Y, 112M, 112C, and 112K, the image forming apparatus 100 may operate in different modes of operation, such as a monochrome printing mode in which only a single imaging station is selectively activated to form a monochrome image, as well as a dual- or tri-color printing mode in which two or three imaging stations are selectively activated to form a multicolor image, depending on a specific print job submitted.

Figure 2:
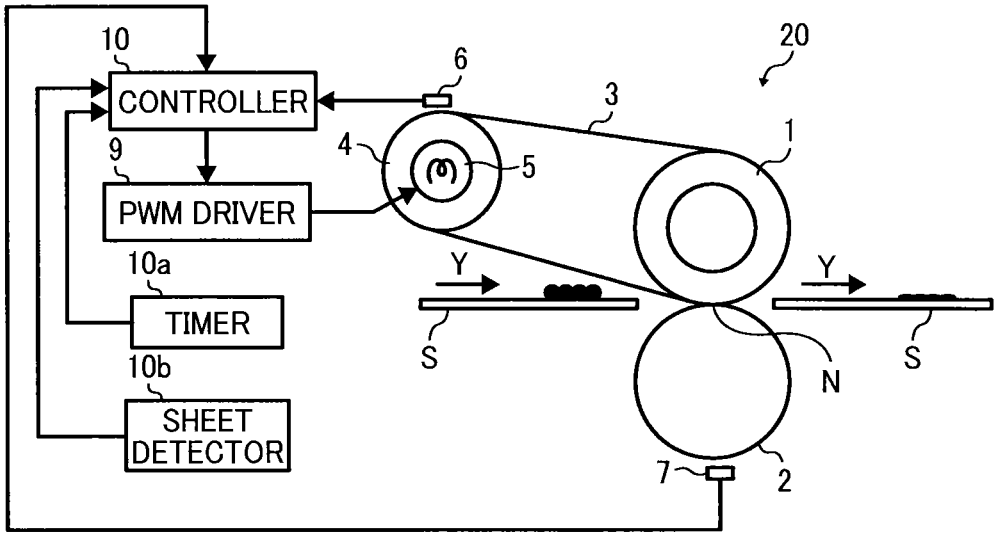
FIG. 2 is an end-on, axial cutaway view of the fixing device according to one embodiment of this patent specification.

FIG. 2 is an end-on, axial cutaway view of the fixing device 20 according to one embodiment of this patent specification.

As shown in FIG. 2, the fixing device 20 includes a fuser roller 1; a hollow, cylindrical heat roller 4 disposed parallel to the fuser roller 1; a heater 5 accommodated in the hollow inside of the heat roller 4; an endless, fuser belt 3 looped for rotation around the fuser roller 1 and the heat roller 4; and a pressure roller 2 disposed opposite the fuser roller 1 with the fuser belt 3 interposed between the pressure roller 2 and the fuser roller 1 to form a fixing nip N therebetween.

At least one of the opposing rollers 1 and 2 forming the fixing nip N is stationary or fixed in position with its rotational axis secured in position to a frame or enclosure of the apparatus body, whereas the other can be positioned with its rotational axis movable while elastically biased against the opposite roller, so that moving the positionable roller relative to the stationary roller allows adjustment of a width of contact between the fuser and pressure members across the fixing nip N.

During operation, the fuser roller 1 rotates in a given rotational direction (i.e., counterclockwise in the drawing) to rotate the fuser belt 3 in the same rotational direction, which in turn rotates the pressure roller 2 in the opposite rotational direction (i.e., clockwise in the drawing). The heat roller 4 is internally heated by the heater 5 to heat a length of the rotating belt 3 to a heating temperature, which is controlled to sufficiently heat and melt toner particles through the fixing nip N.

As the rotary fixing members rotate together, a recording sheet S bearing an unfixed, powder toner image passes through the fixing nip N in a sheet conveyance direction Y to fix the toner image in place, wherein heat from the fuser belt 3 causes toner particles to fuse and melt, while pressure from the pressure roller 2 causes the molten toner to settle onto the sheet surface.

With continued reference to FIG. 2, the fixing device 20 is shown further including a heating controller 10 operatively connected to the heater 5 to control power supply to the heater 5 by adjusting a duty cycle or ratio between an on-time during which the heater power supply is on and an off-time during which the heater power supply is off. Also included are a power supply circuit incorporating a pulse-width modulation (PWM) driver 9 connected between the controller 10 and the heater 5; a first thermometer 6 being a non-contact sensor disposed adjacent to, and out of contact with, the fuser belt 3 to detect an operational temperature of the fuser belt 3 for communication to the controller 10; and a second thermometer 7 disposed adjacent to the pressure roller 2 to detect an operational temperature of the pressure roller 2 for communication to the controller 10.

During operation, the controller 10 adjusts the duty cycle of the heater 5 according to a differential between a specified setpoint temperature and an operational temperature detected in the fixing device 20. The controller 10 directs the PWM circuit 9 to switch on and off the heater power supply according to the duty cycle, so that the fuser belt 3 heated by the internally heated roller 4 imparts a sufficient amount of heat to the incoming sheet S for fixing the toner image through the fixing nip N.

Specifically, in the present embodiment, the heating controller 10 includes a central processing unit (CPU) that controls overall operation of the apparatus, as well as its associated memory devices, such as a read-only memory (ROM) storing program codes for execution by the CPU and other types of fixed data, a random-access memory (RAM) for temporarily storing data, and a rewritable, non-volatile random-access memory (NVRAM) for storing data during power-off.

The heater 5 may be any suitable heat source that can be controlled through on-off switching of electrical power supplied thereto. Examples include electrical resistance heater, such as a halogen lamp or a ceramic heater, as well as electromagnetic induction heater (IH). The heater 5 may be disposed at any position adjoining the fuser member 3. For example, the heater 5 may be positioned inside the heat roller 4 around which the fuser belt 3 rotates. Alternatively, instead, the heater 5 may be positioned in direct contact with the fuser belt 3.

In the present embodiment, the heater 5 is configured as a halogen heater disposed inside the heat roller 4. Operation of the halogen heater 5 may be controlled using a relay circuit that switches on and off an alternating current (AC) power supply to the heater 5 in accordance with the duty cycle. The halogen heater allows for an uncomplicated, inexpensive configuration of the heating equipment, while enabling a high-power output to reduce start-up time and recovery time required by the fixing process.

Figures 3, 4A, 4B, 4C:
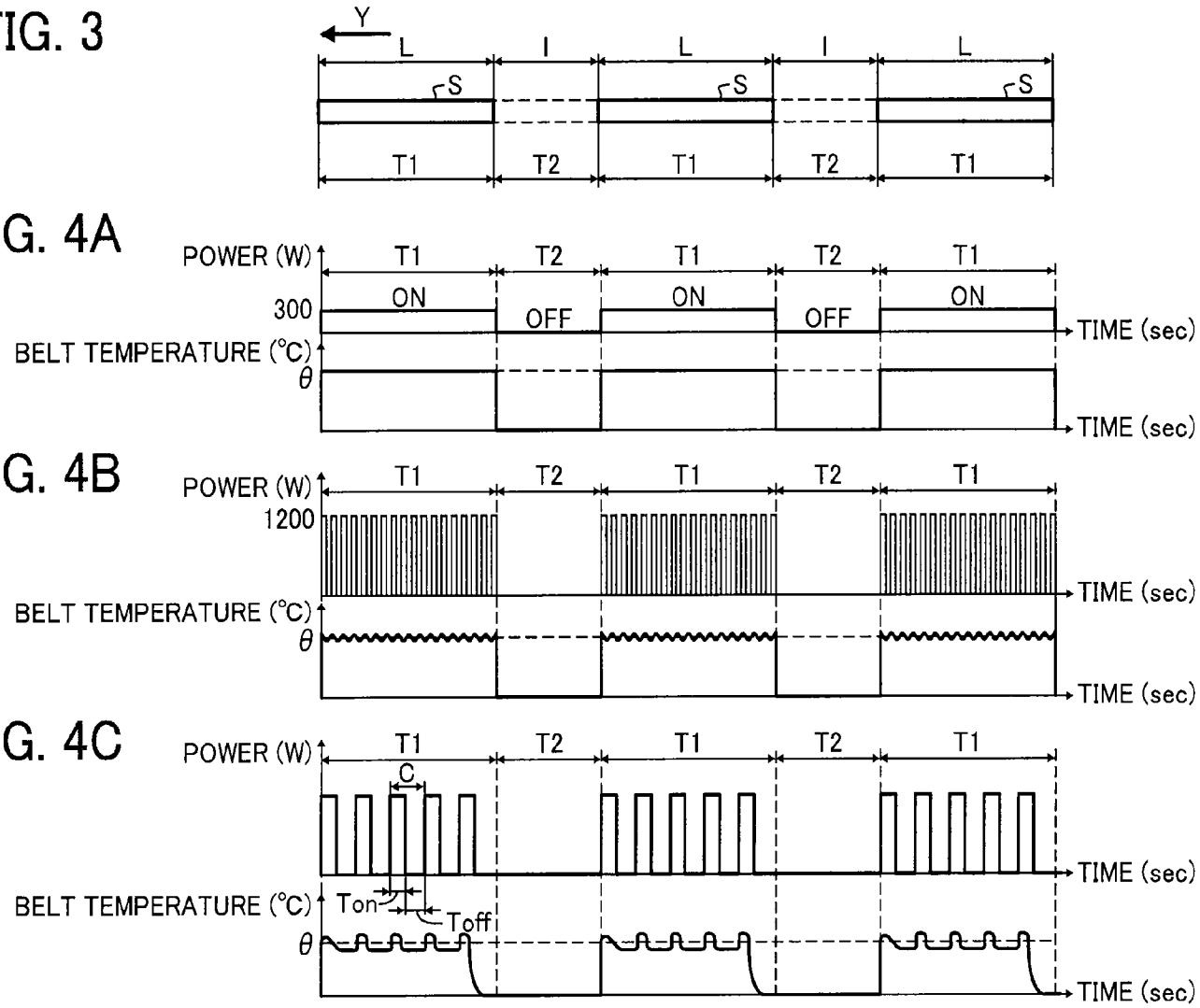
FIG. 3 is a schematic diagram illustrating sequential conveyance of multiple recording sheets through a fixing nip.
FIGS. 4A through 4C each presents exemplary graphs of heater power supply, in watts (W), and temperature, in degrees Celsius (° C.), of a fuser belt, plotted against time, in seconds (sec), during operation of the fixing device.

FIG. 3 is a schematic diagram illustrating sequential conveyance of multiple recording sheets S through the fixing nip N.

As shown in FIG. 3, the recording sheets S, each having a specific length L and spaced apart from each other by an interval distance l in the conveyance direction Y, are sequentially conveyed at a conveyance speed V through the fixing nip N. The sheet length L, the interval distance 1, and the conveyance speed V together determine a length of sheet passage time T1 during which each recording sheet S passes through the fixing nip N, as well as a length of interval time T2 between two successive recording sheets S exiting and subsequently entering the fixing nip N.

For example, with the recording sheets S having a sheet length L of 210 mm and an interval distance l of 126 mm in the conveyance direction Y, sequentially conveying the sheets S at a conveyance speed V of 105 mm/sec results in a sheet passage time T1 of 2.0 seconds and an interval time T2 of 1.2 seconds, that is, a total time length T1+T2 of 3.2 seconds between two successive recording sheets entries through the fixing nip N.

FIGS. 4A through 4C each presents exemplary graphs of heater power supply, in watts (W), and temperature, in degrees Celsius (° C.), of the fuser belt, plotted against time, in seconds (sec), during operation of the fixing device.

As shown in FIG. 4A, for energy-efficient, high-quality fixing performance, the belt temperature is required to be constantly high at a designed heating temperature θ during the sheet passage time T1 and constantly low during the interval time T2. For example, where a halogen heater with a rated power of 1,200 W is employed, the heater needs to be activated with a power supply of 300 W during the sheet passage time T1, and deactivated during the interval time T2 to allow the required changes in the belt temperature.

As shown in FIG. 4B, the halogen heater may be powered through suitable switching circuitry, which controls the 1,200-W AC power supply through a control cycle that has a ratio of the on-time relative to the off-time being ⅓ for the output power of 300 W. In this case, the belt temperature is regulated without substantial deviation from the designed temperature θ during the sheet passage time T1 where the heater power supply is turned on and off at an extremely high switching frequency.

Although effective, however, such high-frequency switching control is difficult to implement where fast repetitive switching of the heater entails adverse consequences. For example, discontinuous power supply would result in insufficient heating of the halogen lamp, which hinders cyclic redeposition of evaporated tungsten to the filament, leading to accelerated degradation and concomitant damage to the filament. Moreover, variations in the heater power supply can interfere with other electronics connected to the mains power, causing, for example, flickering and dimming of lighting fixture where the image forming apparatus is installed.

As shown in FIG. 4C, in practice, in place of high-frequency switching control, the heater power supply is controlled through a series of on-off switching control cycles C, each including an on-time Ton during which the heater power supply is on, and an off-time Toff during which the heater power supply is off. For example, the series of control cycles C each may have a time duration of 0.4 seconds, including an on-time Ton of 0.1 seconds and an off-time Toff of 0.3 seconds. The 0.4-second control cycles C are repeated five times during the sheet passage time T1 and three times during the interval time T2 for the output power of 300 W.

Figure 5:
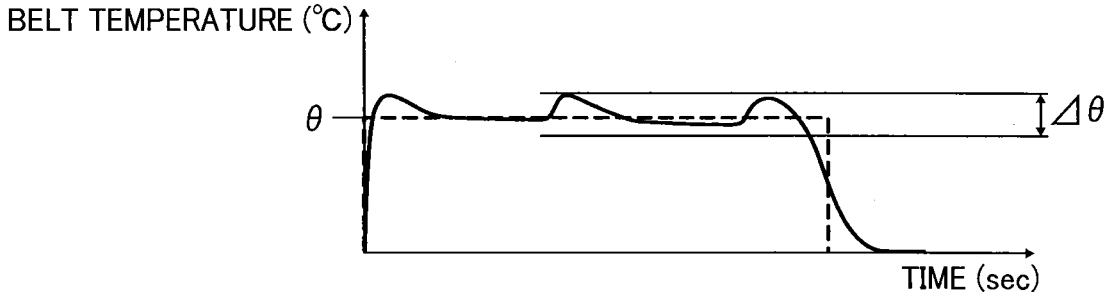
FIG. 5 is a graph illustrating an allowable range of deviation in the belt temperature.

With the heater power supply being thus turned on and off at a relatively low switching frequency, the belt temperature exhibits a certain amount of overshoot from the temperature θ during the on-time Ton, and a certain amount of undershoot from the temperature θ during the off-time Toff. Such low-frequency switching control can be effectively adapted for practical application to obtain adequate imaging quality where the temperature overshoot and undershoot remain below an allowable range AO of, for example, 3° C., that is, ±1.5° C. from the designed temperature θ, as shown in FIG. 5.

The inventors have recognized that one problem associated with a modern energy-efficient fixing process is the difficulty in keeping the temperature deviation within the allowable range during sequential processing of multiple recording media through the fixing nip.

Where the heater power supply is controlled independently of conveyance of the recording medium, a delay or difference in time may arise between when the recording medium enters the fixing nip and when the heater is activated to heat the fuser member. Such a lack of synchronization between heater activation and entry of the recording medium into the fixing nip results in variations in the amount of heat applied to the recording medium, leading to variations in fixing performance.

The problem is particularly pronounced where the equipment exhibits an extremely low heat capacity and thus an extremely fast thermal response to the heater switching on and off, as is the case with a small-diameter roller or a thin, flexible endless rotary belt. Although effective for reducing energy consumption, using such a fixing member makes it difficult to stabilize the temperature in the fixing process.

Figure 6:
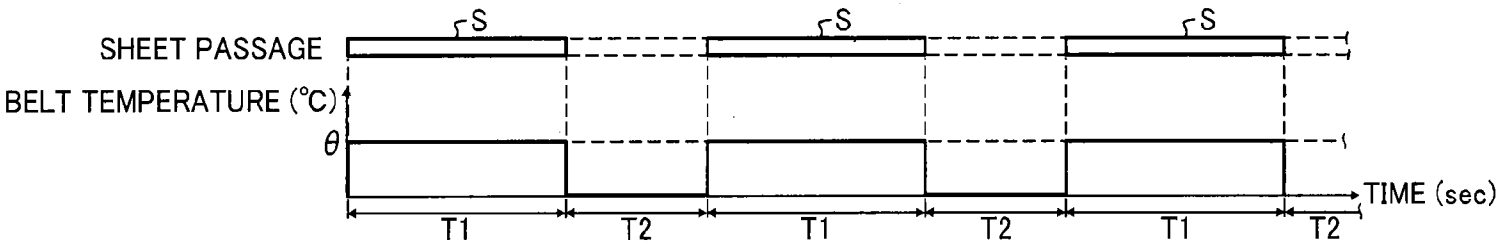
FIG. 6 is an exemplary graph of the belt temperature, in degrees Celsius (° C.), varying with time, in seconds (sec), as multiple recording sheets sequentially passes through the fixing nip.

FIG. 6 is an exemplary graph of the belt temperature, in degrees Celsius (° C.), varying with time, in seconds (sec), as multiple recording sheets S sequentially passes through the fixing nip N.

As shown in FIG. 6, for optimal, energy-efficient, high-quality fixing performance, the belt temperature is required to rise to a designed heating temperature θ as the leading edge of each recording sheet S reaches the fixing nip N, and subsequently fall from the heating temperature θ as the trailing edge of each recording sheet S exits the fixing nip N.

Figure 7:
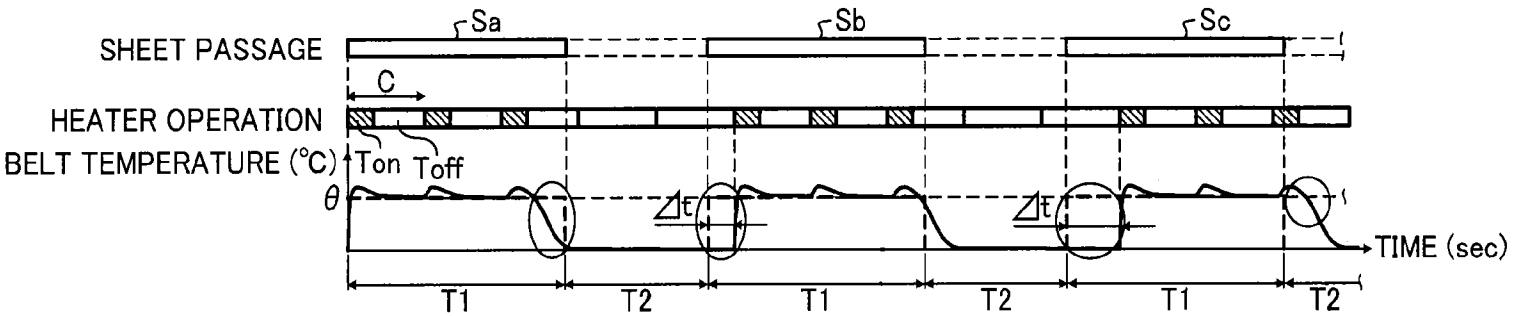
FIG. 7 is an exemplary graph of the belt temperature, in degrees Celsius (° C.), varying with time, in seconds (sec), obtained with a typical heating controller.

FIG. 7 is an exemplary graph of the belt temperature, in degrees Celsius (° C.), varying with time, in seconds (sec), where multiple recording sheets Sa, Sb, and Sc, each having an identical length and spaced apart from each other by a constant interval distance in a conveyance direction, are sequentially conveyed at a constant conveyance speed through the fixing nip N.

As shown in FIG. 7, in this example, the series of control cycles each has a constant duration C consisting of certain periods of an on-time Ton and an off-time Toff, the ratio of which is (although not explicitly presented herein) adjustable according to detected temperatures, such that the heater power supply is turned on approximately three times during passage of each recording sheet S through the fixing nip N.

Under typical heating control, the heater power supply is controlled independently of conveyance of the recording sheet S through the fixing nip N. As a result, changes in the belt temperature do not exactly conform to those required for optimal fixing performance. In particular, the beginning of the sheet passage time T1 does not always coincide with the beginning of the switching control cycle C, as indicated by a delay time Δt between when the recording sheet S enters the fixing nip N and when the heater is activated to heat the fuser belt.

Specifically, the belt temperature falling earlier than the exit of the first recording sheet Sa results in insufficient heating of the trailing edge of the sheet Sa. Further, the belt temperature rising later than the entry of the second recording sheet Sb results in insufficient heating of the leading edge of the sheet Sb. Moreover, the belt temperature rising significantly later than the entry of the third recording sheet Sc results in insufficient heating of the leading edge of the sheet Sc, followed by excessive heating of the trailing edge of the sheet Sc.

Thus, independent control of the heater power supply and conveyance of the recording medium S can preclude synchronization between heater activation and entry of the recording sheet S into the fixing nip N, which eventually results in variations in the amount of heat applied to the recording sheet S, leading to variations in fixing performance.

To address this and other problems, the fixing device 20 according to this patent specification incorporates a special heating control that controls power supply to the heater 5 through a series of on-off switching control cycles in synchronization with conveyance of the recording sheet S, such that a time interval between two successive recording sheets S entering the fixing nip N equals an integer multiple of a duration of one control cycle. The heating control can reset timing of at least one of the series of control cycles C, such that the heater 5 is activated simultaneously with entry of the recording sheet S into the fixing nip N.

Specifically, the heating controller 10 controls power supply to the heater 5 through a series of on-off switching control cycles, each including an on-time during which the heater power supply is on, and an off-time during which the heater power supply is off, in synchronization with conveyance of the recording sheet S to satisfy the following equation:

$$T1+T2=C*X \qquad \text{Equation (1)}$$

where "T1" is a length of sheet passage time during which each recording sheet S passes through the fixing nip N, "T2" is a length of interval time between two successive recording sheets S exiting and subsequently entering the fixing nip N, "C" is a duration of the control cycle of the heater power supply, and "X" is a cycle count being a positive integer.

Given that the speed at which the fuser and pressure member rotate is constant during processing of a single recording sheet S, the above equation may be rewritten as follows:

$$(L+1)/V=C*X \qquad \text{Equation (1.1)}$$

where "L" is a length of the recording sheet S in the conveyance direction Y, "1" is a length of interval distance between two recording sheets S in the conveyance direction Y, and "V" is the conveyance speed at which the recording sheet S is conveyed.

Figure 8:
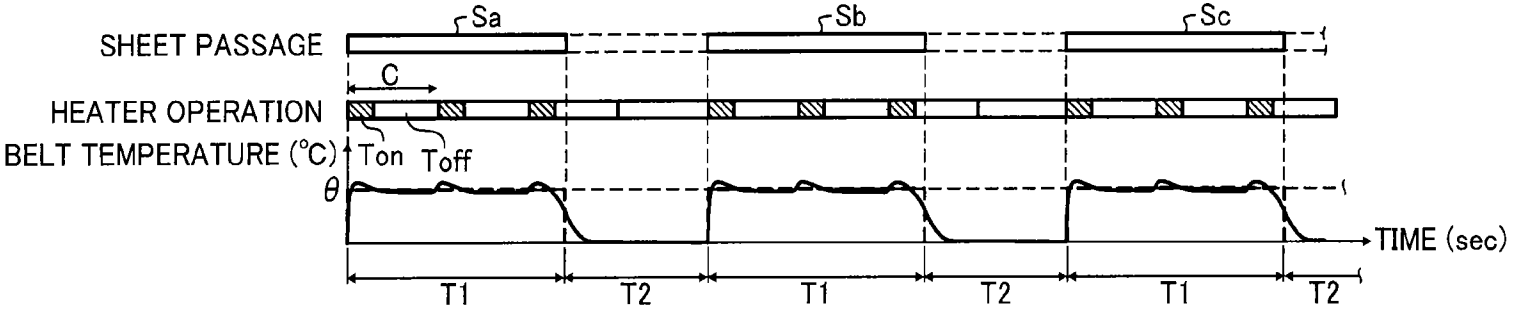
FIG. 8 is an exemplary graph of the belt temperature, in degrees Celsius (° C.), varying with time, in seconds (sec), obtained with a heating control included in the fixing device of FIG. 2.

FIG. 8 is an exemplary graph of the belt temperature, in degrees Celsius (° C.), varying with time, in seconds (sec), where multiple recording sheets Sa, Sb, and Sc, each having an identical length and spaced apart from each other by a constant interval distance in a conveyance direction, are sequentially conveyed at a constant conveyance speed through the fixing nip N, obtained with the heating controller 10.

As shown in FIG. 8, in this example, the series of control cycles each has a constant duration C consisting of certain periods of an on-time Ton and an off-time Toff, the ratio of which is (although not explicitly presented herein) adjustable according to detected temperatures, such that the heater power supply is turned on approximately three times during passage of each recording sheet S through the fixing nip N.

Under the heating control according to this patent specification, the heater power supply is controlled in synchronization with conveyance of the recording sheet S, such that the total time length T1+T2 between two successive recording sheets S entering the fixing nip N equals the duration of one control cycle C multiplied by the cycle count X of four. As a result, changes in the belt temperature substantially conform to those required for optimal fixing performance, as indicated by broken lines in the graph. In particular, the beginning of the sheet passage time T1 always coincides with the beginning of each switching control cycle, without a delay time between when the recording sheet S enters the fixing nip N and when the heater 5 is activated to heat the fuser belt 3.

Thus, the heating control according to this patent specification can effectively synchronize heater activation and entry of the recording medium S into the fixing nip N, leading to optimal, energy-efficient, and high-quality fixing performance of the fixing device 20.

The controller 10 may adjust at least one of the conveyance speed V, the interval distance 1, the cycle duration C, the cycle count X, and combinations thereof to keep the Equation (1) satisfied. Adjustment to those parameters may be performed depending on a print job or application in which printing is performed with a specific imaging speed or rating of pages per minute (PPM), that is, the number of recording sheets S passing through the fixing nip N during one minute, using a particular type of recording medium S having a specific length L in the conveyance direction Y, such as a long edge of A4 size, a short edge of A4 size, a long edge of A3 size, a short edge of A3 size, a long edge of letter size, and a short edge of letter size.

For example, the cycle duration C and the cycle count X may be selectively adjusted where the conveyance speed V and the interval distance l are determined by a given imaging speed. Further, not only the cycle duration C and the cycle count X, but also the conveyance speed V and the interval distance l may be adjusted where the imaging speed is changeable. Several such embodiments are described below.

In one embodiment, the controller 10 adjusts a combination of the cycle duration C and the cycle count X to accommodate changes in the conveyance speed V causing corresponding changes in the total time length T1+T2, which may occur, for example, depending on a specific rating of PPM.

Specifically, the controller 10 selects a suitable combination of the cycle duration C and the cycle count X using a lookup table stored in a memory device accessible by the controller 10, which associates different values of the conveyance speed V with different combinations of the parameters C and X. Such a lookup table may contain a combination of parameters C and X for all possible values of the variable, or otherwise for at least values associated with frequently used print settings, such as A4-, A3-, and letter-sized paper sheets. Table 1 below provides an exemplary lookup table for heating control according to the present embodiment.

TABLE 1

| | | | | | X |
|---|---|---|---|---|---|
| PPM | 20 | 30 | 40 | 50 | |
| L (mm) | 210 | 210 | 210 | 210 | |
| 1 (mm) | 60 | 60 | 60 | 60 | |
| V (mm/sec) | 90 | 135 | 180 | 225 | |
| T1 + T2 (sec) | 3 | 2 | 1.5 | 1.2 | |
| C (msec) | 3,000 | 2,000 | 1,500 | 1,200 | 1 |
| | 1,500 | 1,000 | 750 | 600 | 2 |
| | 1,000 | 667 | 500 | 400 | 3 |
| | 750 | 500 | 375 | 300 | 4 |
| | 600 | 400 | 300 | 240 | 5 |
| | 500 | 333 | 250 | 200 | 6 |
| | 429 | 286 | 214 | 171 | 7 |
| | 375 | 250 | 188 | 150 | 8 |
| | 333 | 222 | 167 | 133 | 9 |
| | 300 | 200 | 150 | 120 | 10 |

In Table 1, values are presented for application in four types of imaging equipment, each operated with a particular conveyance speed V for A4-size, long-edge feed paper. Values of the cycle duration C are rounded off to the nearest integer.

Reducing the cycle duration C may increase controllability of the fuser temperature, while too short a cycle duration would result in accelerated degradation of the halogen heater or flickering of lighting equipment. To obtain good controllability without adverse effects, the cycle duration C may be set to a sufficiently long range of, for example, 600 milliseconds or longer.

For example, the following combinations may be selected based on Table 1: a cycle duration C of 600 msec and a cycle count X of 5 for a speed V of 90 mm/sec; a cycle duration C of 667 msec and a cycle count X of 3 for a speed V of 135 mm/sec; a cycle duration C of 750 msec and a cycle count X of 2 for a speed V of 180 mm/sec; and a cycle duration C of 600 msec and a cycle count X of 2 for a speed V of 225 mm/sec.

In further embodiment, the controller 10 adjusts a combination of the cycle duration C and the cycle count X to accommodate changes in the length L of the recording medium in the conveyance direction Y causing corresponding changes in the total time length T1+T2, which may occur, for example, depending on a specific print job.

Specifically, as is the case with the foregoing embodiment, the controller 10 selects a suitable combination of the cycle duration C and the cycle count X using a lookup table stored in a memory device accessible by the controller 10, which associates different values of the sheet length L with different combinations of the parameters C and X. Such a lookup table may contain a combination of combinations of parameters C and X for all possible values of the variable, or otherwise for at least values associated with frequently used print settings, such as A4-, A3-, and letter-sized paper sheets.

In still further embodiment, the controller 10 adjusts a combination of the interval distance l and the cycle count X to accommodate changes in the conveyance speed V causing corresponding changes in the total time length T1+T2.

Specifically, as is the case with the foregoing embodiment, the controller 10 selects a suitable combination of the interval distance l and the cycle count X using a lookup table stored in a memory device accessible by the controller 10, which associates different values of the conveyance speed V with different combinations of the parameters l and X. Table 2 below provides an exemplary lookup table for heating control according to the present embodiment.

TABLE 2

| | | | | | X | T1 + T2 (sec) | PPM |
|---|---|---|---|---|---|---|---|
| L (mm) | 210 | 210 | 210 | 210 | | | |
| C (msec) | 600 | 600 | 600 | 600 | | | |
| V (mm/sec) | 90 | 135 | 180 | 225 | | | |
| 1 (mm) | −156* | −129* | −102* | −75* | 1 | 0.6 | 100.0 |
| | −102* | −48* | 6 | 60 | 2 | 1.2 | 50.0 |
| | −48* | 33 | 114 | 195 | 3 | 1.8 | 33.3 |
| | 6 | 114 | 222 | 330 | 4 | 2.4 | 25.0 |
| | 60 | 195 | 330 | 465 | 5 | 3.0 | 20.0 |
| | 114 | 276 | 438 | 600 | 6 | 3.6 | 16.7 |
| | 168 | 357 | 546 | 735 | 7 | 4.2 | 14.3 |
| | 222 | 438 | 654 | 870 | 8 | 4.8 | 12.5 |
| | 276 | 519 | 762 | 1,005 | 9 | 5.4 | 11.1 |
| | 330 | 600 | 870 | 1,140 | 10 | 6.0 | 10.0 |

In Table 2, values are presented for application in four types of imaging equipment, each operated with a particular conveyance speed V for A4-size, long-edge feed paper. Values marked with asterisks (*) indicate negative, invalid values for the interval distance 1, which are presented only for illustration.

For example, the following combinations may be selected based on Table 2: an interval distance l of 60 mm and a cycle count X of 5 for a speed V of 90 mm/sec, yielding a total time length T1+T2 of 3.0 sec and PPM of 20.0; an interval distance l of 114 mm and a cycle count X of 4 for a speed V of 135 mm/sec, yielding a total time length T1+T2 of 2.4 sec and PPM of 25.0; an interval distance l of 114 mm and a cycle count X of 3 for a speed V of 180 mm/sec, yielding a total time length T1+T2 of 1.8 sec and PPM of 33.3; and an interval distance l of 60 mm and a cycle count X of 2 for a speed V of 225 mm/sec, yielding a total time length T1+T2 of 1.2 sec and PPM of 50.0.

Since changing the interval distance l causes a corresponding change in the PPM value, the configuration described above is applicable where variations in the imaging speed are allowable. Alternatively, instead, where the imaging speed is unchangeable, the controller 10 may adjust the interval distance l and the cycle count X for each of the multiple recording sheets S to maintain a constant imaging speed during execution of a print job.

Figure 9:
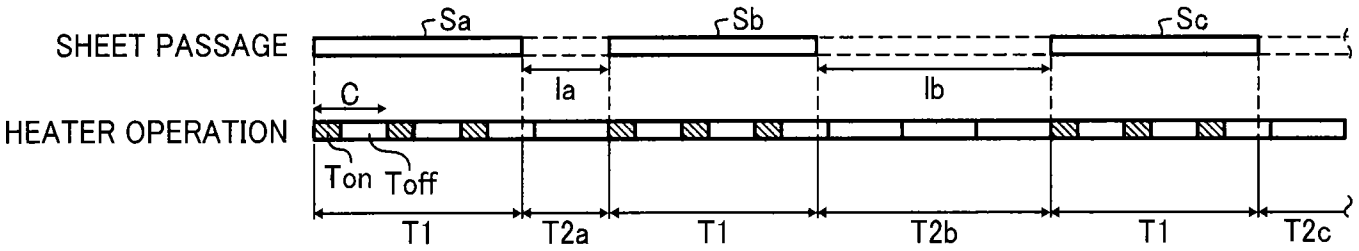
FIG. 9 is a schematic diagram illustrating an arrangement of the heating control of FIG. 8.

With reference to FIG. 9, during sequential processing of multiple recording sheets S, the controller 10 specifies different combinations of the interval distance l and the cycle count X for three successive recording sheets Sa, Sb, and Sc. For example, the first recording sheet Sa is processed with a relatively short interval distance 1*a* and a smaller cycle count X of 4, whereas the second sheet Sb is processed with a relatively long interval distance 1*b* and a greater cycle count X of 6. Such arrangement enables synchronization between heater activation and entry of the recording medium into the fixing nip without causing variations in the imaging speed.

Figure 10:
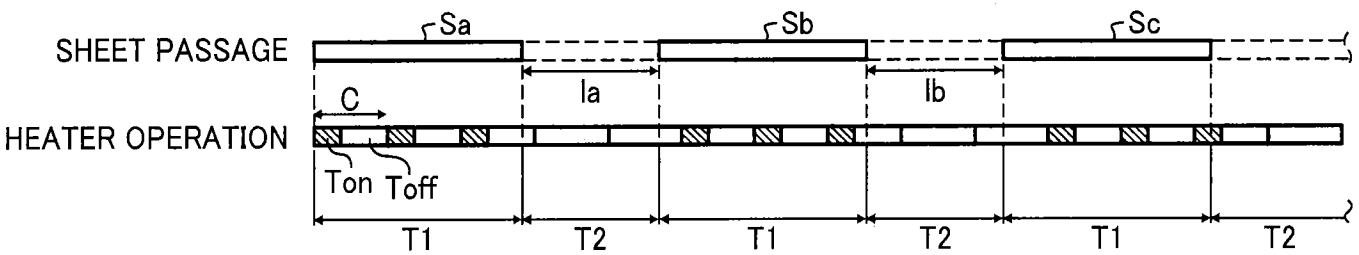
FIG. 10 is a schematic diagram illustrating a typical heating control.

For comparison purposes, consider a case where heating control is performed without adjustment to the interval distance l and the cycle count X, with reference to FIG. 10. As shown in FIG. 10, although causing no variations in the imaging speed, operation with the fixed interval distance l and the fixed cycle count X would result in a delay time between when each of the second and third recording sheets Sb and Sc enters the fixing nip N and when the heater is activated to heat the fuser belt, leading to variations in fixing performance.

In still further embodiment, the controller 10 adjusts the cycle duration C to accommodate changes in the interval distance l causing corresponding changes in the total time length T1+T2. The controller 10 may perform such adjustment where the interval distance l changes as the imaging speed or PPM changes during execution of a print job. An example of such arrangement is illustrated in FIG. 11.

Figure 11:
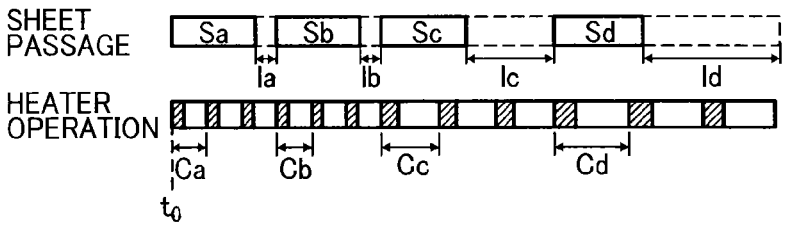
FIG. 11 is a schematic diagram illustrating an arrangement of the heating control of FIG. 8.

As shown in FIG. 11, as multiple recording sheets Sa, Sb, Sc, and Sd pass through the fixing nip N during execution of a single print job, the interval distance l may increase from 1*b* to 1*c* between the second and third sheets Sb and Sc, and from 1*c* to 1*d* between the third and fourth sheets Sc and Sd to gradually reduce the imaging speed. To accommodate the changes, the controller 10 increases the control cycle from Cb to Cc, and subsequently from Cc to Cd, so as to synchronize heater activation and entry of the recording sheets S into the fixing nip N.

For example, where sequential printing is performed with an initial control cycle of 1,000 msec, a conveyance speed V of 90 mm/sec, a sheet length L of 210 mm (corresponding to A4-size, long edge feed paper), and a cycle count X of three, the interval distance l may increase from 60 mm to 222 mm between the second and third sheets Sb and Sc, so that the total time length T1+T2 increases from 3.0 sec to 4.8 sec and the PPM value decreases from 20.0 to 12.5. In this case, the controller 10 may increase the cycle duration C from 1,000 msec to 1,600 msec between the second and third sheets Sb and Sc.

Although in the embodiment depicted in FIG. 11, the interval distance l increases to decrease the imaging speed, adjustment to the cycle duration C may be performed where the interval distance l decreases to increase the imaging speed. Further, adjustment to the cycle duration C may be performed in conjunction with adjustment to the cycle count X, that is, the controller 10 may adjust a combination of the cycle duration C and the cycle count X to accommodate changes in the interval distance 1. The controller 10 may perform such adjustment where the interval distance l changes as the imaging speed changes during execution of a print job.

In yet still further embodiment, the controller 10 adjusts the cycle count X to accommodate changes in the interval distance 1, causing corresponding changes in the total time length T1+T2. The controller 10 may perform such adjustment where the interval distance l changes as the imaging speed changes during execution of a print job.

Specifically, as is the case with the foregoing embodiment, the controller 10 selects a suitable value of the cycle count X using a lookup table stored in a memory device accessible by the controller 10, which associates different values of the interval distance l with different values of the parameter X. Table 3 below provides an exemplary lookup table for heating control according to the present embodiment.

TABLE 3

| | | 1 (mm) | T1 + T2 (sec) | PPM |
|---|---|---|---|---|
| L (mm) | 210 | | | |
| C (msec) | 600 | | | |
| V (mm/sec) | 90 | | | |
| X | 1 | −156* | 0.6 | 100.0 |
| | 2 | −102* | 1.2 | 50.0 |
| | 3 | −48* | 1.8 | 33.3 |
| | 4 | 6 | 2.4 | 25.0 |
| | 5 | 60 | 3.0 | 20.0 |
| | 6 | 114 | 3.6 | 16.7 |
| | 7 | 168 | 4.2 | 14.3 |
| | 8 | 222 | 4.8 | 12.5 |
| | 9 | 276 | 5.4 | 11.1 |
| | 10 | 330 | 6.0 | 10.0 |

In Table 3, values are presented for application in a type of imaging equipment operated with a particular conveyance speed V for A4-size, long-edge feed paper. Values marked with asterisks (*) indicate negative, invalid values for the interval distance 1, which are presented only for illustration.

For example, where the imaging speed or PPM is set to 20, the interval distance l is 60 mm with the cycle count X of 5, yielding a total time length T1+T2 of 3.0 sec. As the PPM value changes from 20 to 16.7, the controller 10 adjusts the interval distance l from 60 mm to 114 mm, and the cycle count X from 5 to 6, such that the total time length T1+T2 changes from 3.0 sec to 3.6 sec.

As mentioned earlier, in the fixing device 20 according to this patent specification, the heating controller 10 can reset timing of at least one of the series of control cycles C, such that the heater 5 is activated simultaneously with entry of the recording medium S into the fixing nip N. A description is now given of such features of the fixing device 20 with reference to FIG. 12 and subsequent drawings.

Figure 12:
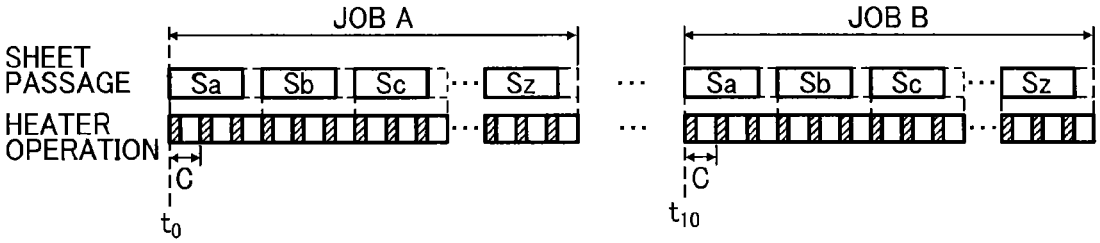
FIG. 12 is a schematic diagram illustrating the heating control according to one embodiment of this patent specification.

FIG. 12 is a schematic diagram illustrating the heating control according to one embodiment of this patent specification.

As shown in FIG. 12, in the present embodiment, the controller 10 resets timing of the control cycle C upon initiation of a print job, so as to synchronize heater activation with initial entry of the recording sheet S into the fixing nip N during execution of the print job.

Specifically, where two consecutive print jobs A and B are submitted to cause multiple recording sheets Sa through Sz to sequentially pass through the fixing nip N, the controller 10 resets timing of the control cycle C as each of the print jobs A and B is initialized at times t0 and t10, respectively. As a result, the recording sheet Sa initially enters the fixing nip N simultaneously with the heater 5 being powered on.

In such a configuration, the number of times the heater 5 is activated during passage of the recording sheet S is constant for each recording sheet S throughout the operation. In the present case, for example, heater activation takes place three times for each recording sheet S during execution of both the print job A and the print job B. Keeping a constant frequency of heater activation for each recording sheet S translates into a constant amount of heat applied to each recording sheet S, leading to stable fixing performance through the fixing nip N.

Additionally, the controller 10 may be provided with suitable equipment to determine when the recording sheet S enters the fixing nip N. For example, with reference to FIG. 2, the controller 10 may calculate the sheet entry time based on output from a timer 10*a* that measures an elapsed time during conveyance of the recording sheet S upstream from the fixing nip N along the sheet conveyance path P. Alternatively, the controller 10 may calculate the sheet entry time based on output from a sheet detector 10*b* that detects passage of the recording sheet S upstream from the fixing nip N along the sheet conveyance path P.

Figure 13:
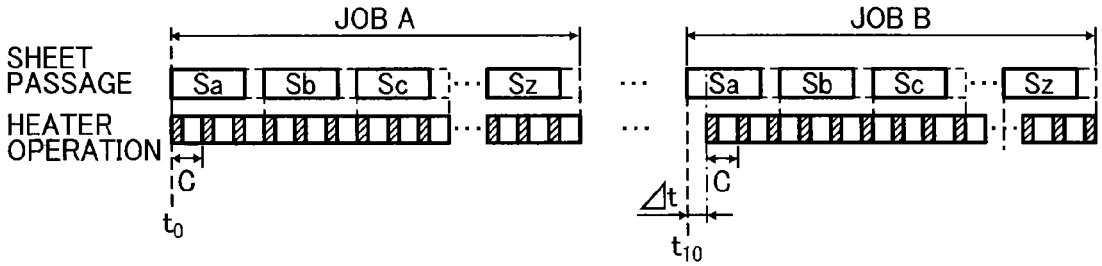
FIG. 13 is a schematic diagram illustrating a typical heating control.

For comparison purposes, consider a configuration where consecutive print jobs A and B are executed without the timing reset function, with reference to FIG. 13.

As shown in FIG. 13, there is a time delay Δt between heater activation and entry of the recording sheet Sa into the fixing nip N upon initiation of the print job B, whereas heater activation synchronizes with entry of the recording sheet Sa into the fixing nip N during execution of the print job A, resulting in a varying number of times the heater is activated during passage of the recording sheet S throughout the operation. In the present case, heater activation takes place three times for each recording sheet S during execution of the print job A, and twice for each recording sheet S during execution of the print job B. Variations in the frequency of heater activation for each recording sheet S translate into variations in the amount of heat applied to each recording sheet S, leading to unstable fixing performance through the fixing nip N.

Figure 14:
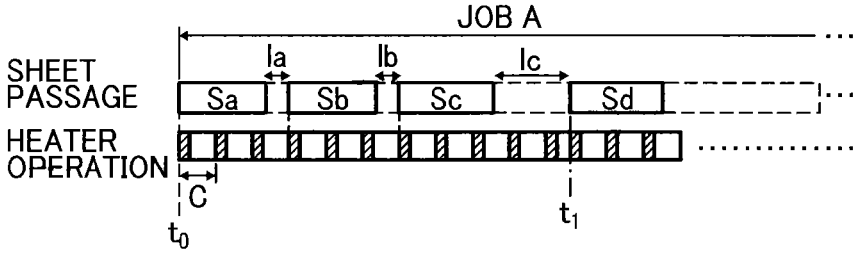
FIG. 14 is a schematic diagram illustrating the heating control according to another embodiment of this patent specification.

FIG. 14 is a schematic diagram illustrating the heating control according to another embodiment of this patent specification.

As shown in FIG. 14, in the present embodiment, the controller 10 resets timing of the control cycle C where the imaging speed changes during execution of a print job, so as to synchronize heater activation with initial entry of the recording sheet S into the fixing nip N after the change to the imaging speed.

Specifically, where the interval distance l increases from 1*b* to 1*c* during execution of a single print job A, the controller 10 resets timing of the control cycle C at time t1 as the recording sheet Sd initially enters the fixing nip after the change to the interval distance 1. As a result, the recording sheet Sd enters the fixing nip N simultaneously with the heater 5 being powered on.

In such a configuration, the number of times the heater 5 is activated during passage of the recording sheet S is constant for each recording sheet S throughout the operation. In the present case, for example, heater activation takes place three times for each recording sheet S both before and after the imaging speed changes during execution of the print job A. Keeping a constant frequency of heater activation for each recording sheet S translates into a constant amount of heat applied to each recording sheet S, leading to stable fixing performance through the fixing nip N.

The present embodiment is applicable in a configuration in which the interval distance l is adjusted to compensate for variations in the supply of heat from the heater 5 to the fuser belt 3, for example, where the fuser belt 3 loses substantial amounts of heat due to continuous contact with a large number of recording sheets S processed sequentially through the fixing nip N, or where sequential processing of narrow or small-sized recording sheets S through the fixing nip N causes excessive heating of those portions of the fuser belt 3 which remain out of contact with the recording sheets S to accumulate heat supplied from the heater 5, causing the belt temperature to deviate from a desired temperature range. Once the belt temperature reaches the desired temperature range, the controller 10 may reset the interval distance l to the original value to recover the original imaging speed.

Figure 15:
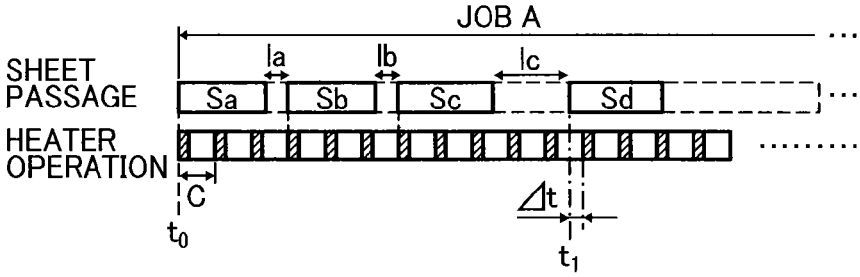
FIG. 15 is a schematic diagram illustrating a typical heating control.

For comparison purposes, consider a configuration where the imaging speed changes during execution of a print job A without the timing reset function, with reference to FIG. 15.

As shown in FIG. 15, there is a time delay Δt between heater activation and entry of the recording sheet Sd into the fixing nip N after the change to the imaging speed caused by an increase in the interval distance l during execution of the print job A, resulting in a varying number of times the heater is activated during passage of the recording sheet S throughout the operation. In the present case, heater activation takes place three times for each recording sheet S before the change to the imaging speed and twice for each recording sheet S after the change to the imaging speed. Variations in the frequency of heater activation for each recording sheet S translate into variations in the amount of heat applied to each recording sheet S, leading to unstable fixing performance through the fixing nip.

In further embodiment, the controller 10 may reset timing of the cycle duration C in a condition in which an expected difference in time between heater activation and entry of the recording sheet S into the fixing nip N exceeds 100 milliseconds.

Figure 16:
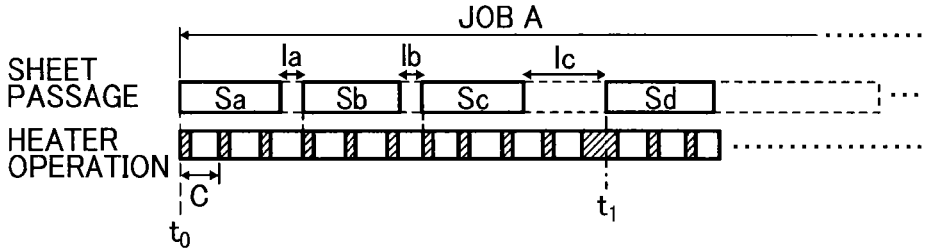
FIG. 16 is a schematic diagram illustrating a typical heating control.

Such arrangement prevents excessively frequent resetting of the control cycle due to frequent changes to the imaging speed. Performing the timing reset function without any limitation or condition would adversely affect proper functioning of the heating controller. This is particularly true where the control cycle immediately before timing reset is assigned a relatively long on-time, which, if combined with an on-time in the control cycle immediately after timing reset, would result in an excessively long duration of heater activation, and consequently, an excessive heat supply to the fuser belt, as shown in FIG. 16.

In still further embodiment, the controller 10 may adjust the on-time Ton to maintain a constant duty ratio of the on-time Ton relative to a sum of the on-time Ton and the off-time Toff in the control cycle upon timing reset. An example of such arrangement is depicted in FIGS. 17 and 18.

Figure 17:
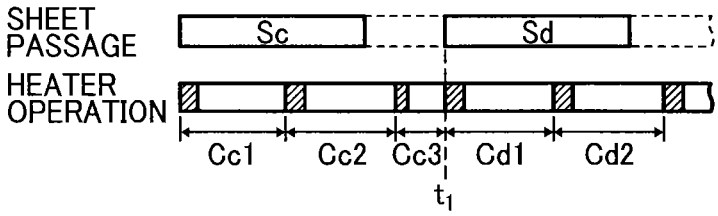
FIG. 17 is a schematic diagram illustrating an arrangement of the heating control of FIG. 14.
Figure 18:
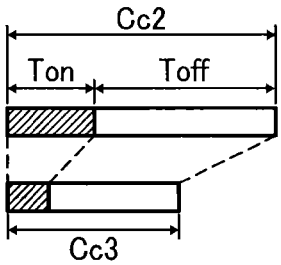
FIG. 18 is another schematic illustration of the arrangement of FIG. 17.

As shown in FIG. 17, in the present embodiment, the controller 10 reduces the on-time Ton in a control cycle Cc3 upon timing reset at time t1. The resultant duty ratio 30%, which is consistent with the duty ratio for a control cycle Cc2 immediately before timing reset, as shown in FIG. 18. The controller 10 may have a suitable computational capability to calculate an expected change to the duration of the control cycle Cc3 upon timing reset.

Such arrangement prevents a temporary increase in the duty cycle where resetting of the control cycle reduces or eliminates the off-time while leaving the on-time unchanged in the control cycle upon timing reset, which would otherwise result in an excessively long duration of heater activation, and consequently, an excessive heat supply to the fuser belt.

Hence, the fixing device 20 according to this patent specification can effectively prevent variations in fixing performance during sequential processing of multiple recording sheets S through the fixing nip N, or upon a change in imaging speed measured in terms of number of recording sheets S per unit time, owing to provision of the heating controller 10 that resets timing of at least one of the series of control cycles, such that the heater 5 is activated simultaneously with entry of the recording sheet S into the fixing nip N.

With the timing reset function, the number of times the heater 5 is activated during passage of the recording sheet S is constant for each recording sheet S, or more precisely, for a given length of recording sheet S in the conveyance direction Y, throughout the operation. Keeping a constant frequency of heater activation translates into a constant amount of heat applied to each recording sheet S, leading to stable fixing performance through the fixing nip N.

Although a particular configuration has been illustrated, the fixing device 20 may be configured otherwise than that depicted primarily with reference to FIG. 2, with appropriate modifications to the material, number, size, shape, position, and other features of components included in the fixing device. In each of those alternative embodiments, various beneficial effects may be obtained owing to the heating control according to this patent specification.

Figure 19:
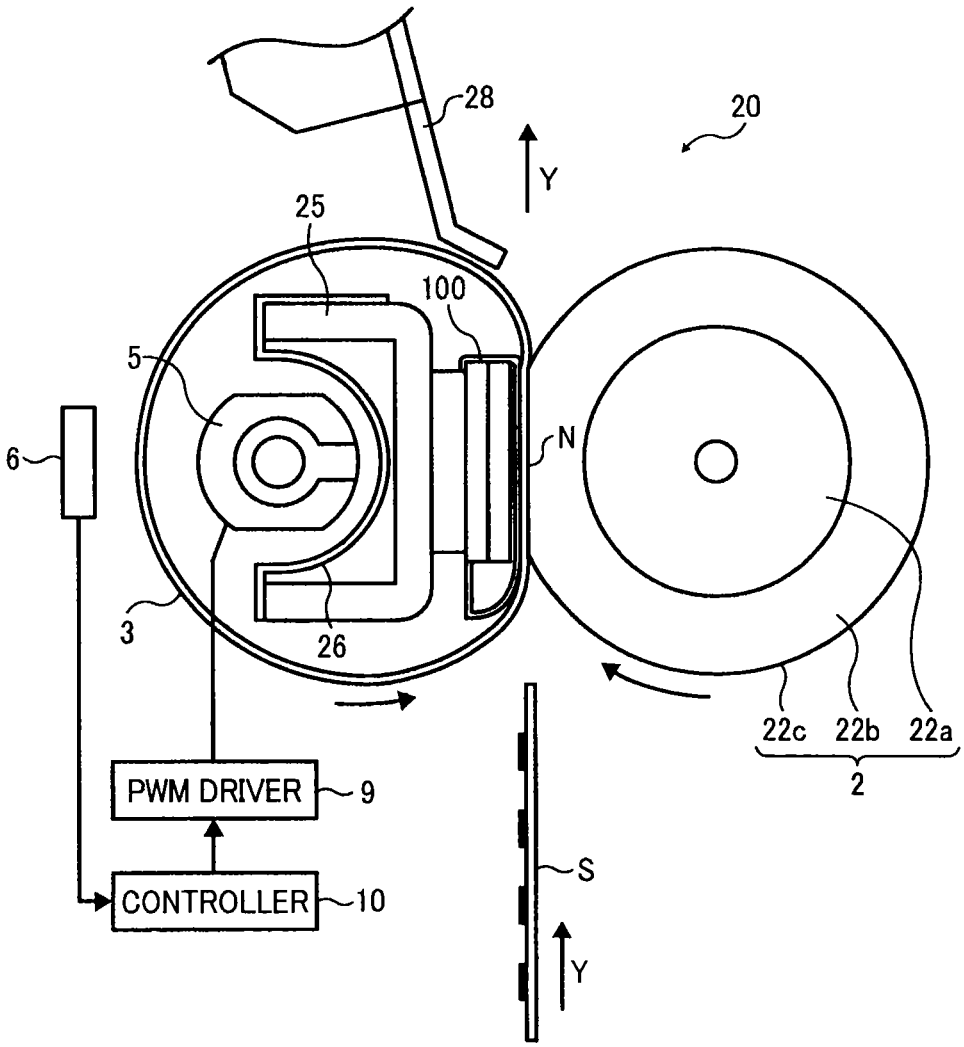
FIG. 19 is an end-on, axial cutaway view of the fixing device according to another embodiment of this patent specification.

FIG. 19 is an end-on, axial cutaway view of the fixing device 20 according to another embodiment of this patent specification.

As shown in FIG. 19, the overall configuration of the fixing device 20 is similar to that depicted primarily with reference to FIG. 2, including an endless, rotary fuser belt 3 looped for rotation while subjected to heating; a pressure roller 2 disposed opposite the fuser member 3 to form a fixing nip N therebetween; a heater 5 disposed inside the loop of the fuser belt 3 to heat the belt 3; and a heating controller 10 connected to the heater 5 via suitable driver circuitry to control the heater operation. A thermometer 6 is disposed adjacent to the fuser belt 3 to detect temperature of the belt 3.

Although not specifically depicted, a biasing mechanism is provided to press the pressure roller 2 against the fuser belt 3 with a desired length and strength across the fixing nip N. An actuator, such as a rotary motor, is provided to rotate the pressure roller 2, which in turn imparts torque to the fuser belt 3 at the fixing nip N.

Unlike the foregoing embodiment, the fixing device 20 employs a stationary fuser pad 100, instead of the rotatable fuser roller 1, against which the pressure roller 2 presses via the fuser belt 3. A stay 25 may be disposed inside the loop of the fuser belt 3 to reinforce the fuser pad 100 against nip pressure. A stripping member 28 may be disposed downstream from the fixing nip N to separate the recording sheet S from the fuser belt 3 at the exit of the fixing nip N.

Specifically, in the present embodiment, the fuser belt 3 comprises a thin, flexible endless belt or film having a multi-layered structure, formed of a substrate of metal or resin and a layer of release agent deposited on the substrate, which is looped into a generally cylindrical configuration with the substrate facing inside and the release layer facing outside the belt loop. Optionally, an intermediate layer of elastic material may be disposed between the substrate and the release layer.

The pressure roller 2 comprises a solid cylindrical body formed of a cylindrical core of metal 22*a*, covered with an intermediate elastic layer 22*b* and an outer release coating 22*c* deposited one upon another. Alternatively, instead of a solid roller, the pressure roller 2 may be configured as a hollow cylindrical body, in which case a dedicated heat source, such as a halogen heater, may be provided inside the pressure roller 2.

The heater 5 comprises a halogen heater that radiates heat to the fuser belt 3. Alternatively, instead, the heater 5 may be configured as any suitable heating element, such as an induction heater, a resistant heater, a carbon heater, or the like.

Optionally, a piece of reflective material 26 may be disposed where the stay 25 faces the heater 5 to direct radiation from the heater 5 to an inner circumferential surface of the looped belt 3. Provision of the reflector 26 allows an increased amount of light and heat to reach the fuser belt 3 from the heater 5, while preventing heat radiation from being absorbed in the stay 25 or other adjoining structure, resulting in energy saving and high efficiency in heating the fuser belt 3 through the radiant heater 5. Instead of providing a separate reflective element, the stay 25 may be treated with mirror polish or insulation coating, either partially or entirely, to form a reflective surface that prevents heat from being absorbed in the stay 25.

Figure 20:
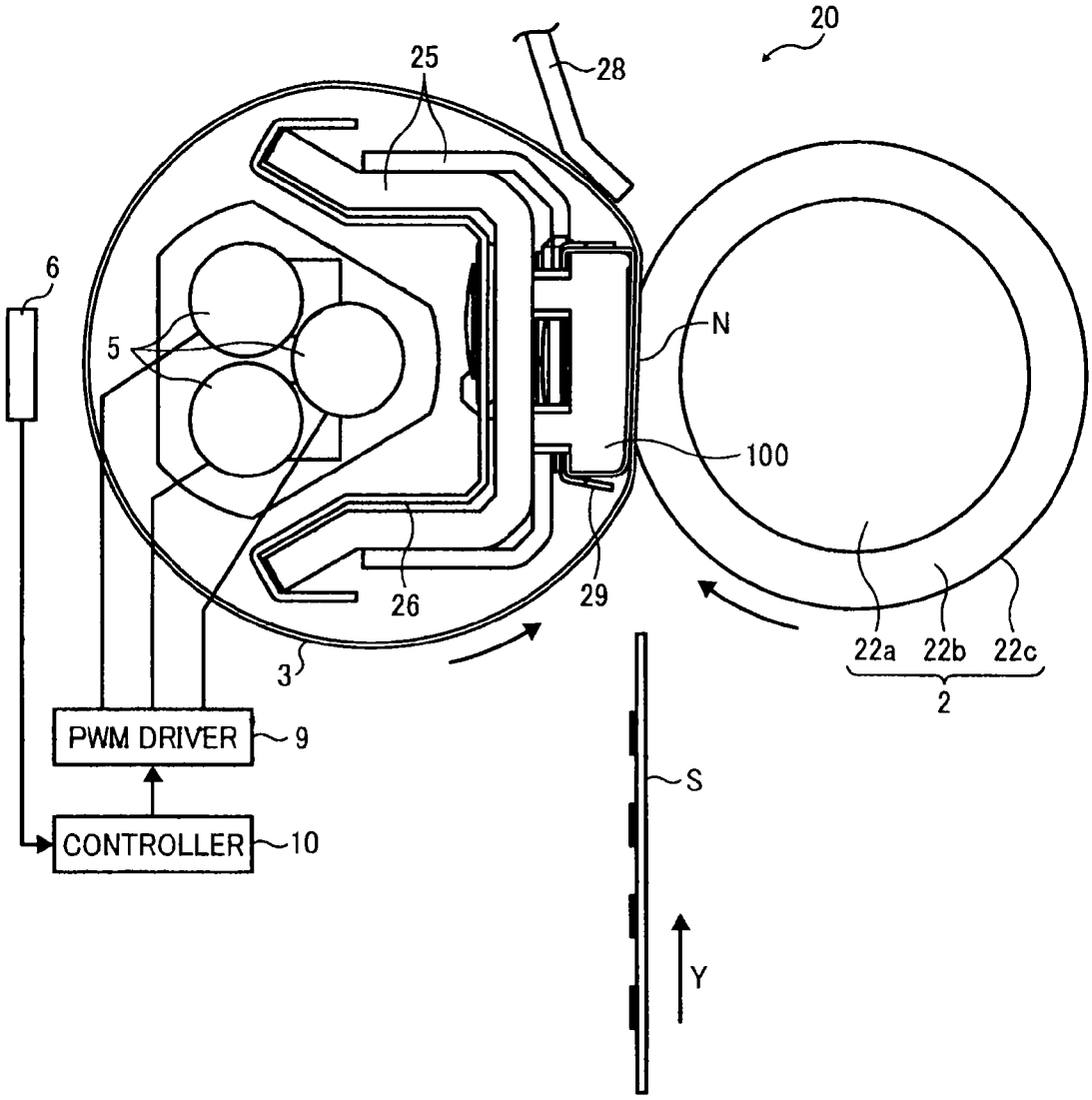
FIG. 20 is an end-on, axial cutaway view of the fixing device 20 according to still another embodiment of this patent specification.

With additional reference to FIG. 20, which is an end-on, axial cutaway view of the fixing device 20 according to still another embodiment of this patent specification, the fixing device 20 may employ a plurality of heating elements 5, instead of a single heating element, to heat the fuser belt 3. Further, the fuser pad 100 may be equipped with a formed sheet of metal 29 that surrounds the fuser pad 100 to stabilize position of the pad 100 with respect to the stay 25.

As is the case with the foregoing embodiment, during operation, the controller 10 adjusts the duty cycle of the heater 5 according to a differential between a specified set-point temperature and an operational temperature detected by the thermometer 6. The controller 10 directs the PWM circuit 9 to switch on and off the heater 5 according to the duty cycle, so that the fuser belt 3 heated by the internally heated roller 4 imparts a sufficient amount of heat to the incoming sheet S for fixing the toner image through the fixing nip N.

The heating controller 10 controls control power supply to the heater through a series of on-off switching control cycles in synchronization with conveyance of the recording sheet S, such that a time interval between two successive recording sheets S entering the fixing nip N equals an integer multiple of a duration of one control cycle. The controller 10 can reset timing of at least one of the series of control cycles, such that the heater 5 is activated simultaneously with entry of the recording sheet S into the fixing nip N.

Numerous additional modifications and variations are possible in light of the above teachings. It is therefore to be understood that, within the scope of the appended claims, the disclosure of this patent specification may be practiced otherwise than as specifically described herein.

What is claimed is:

1. A fixing device comprising:

a rotatable fuser member subjected to heating;

a rotatable pressure member disposed opposite the fuser member, the pressure member pressing against the fuser member to form a fixing nip therebetween, through which multiple recording media, each spaced apart from each other by an interval distance in a conveyance direction, are sequentially conveyed at a conveyance speed;

a heater adjacent to the fuser member to heat the fuser member; and a controller operatively connected to the heater to control a power supply to at least a portion of the heater corresponding to a portion of the fuser member that contacts the multiple recording media through a series of on-off switching control cycles, each on-off switching control cycle including an on-time during which the power supply to the portion of the heater is on to increase heating of the portion of the fuser member, and an off-time during which the power supply to the portion of the heater is off, in synchronization with conveyance of the recording medium to satisfy the following equation:

$$T1+T2=C*X$$

where "T1" is a length of media passage time during which each recording medium passes through the fixing nip, "T2" is a length of interval time between two successive recording media exiting and subsequently entering the fixing nip, "C" is a cycle duration of an on-off switching control cycle of the power supply to the heater, and "X" is a cycle count being a positive integer, wherein the controller resets a timing of a series of on-off switching control cycles corresponding to a print job, such that the heater is activated to heat the fuser member simultaneously with entry of each recording medium for the print job into the fixing nip.

2. The fixing device according to claim 1, wherein the controller resets a timing of the on-off switching control cycle upon initiation of the print job to reset the timing of the series of on-off switching control cycles corresponding to the print job and synchronize heater activation with an initial entry of a first recording medium for the print job into the fixing nip.

3. The fixing device according to claim 1, wherein the controller resets a timing of the on-off switching control cycle where an imaging speed, measured in terms of number of recording media processed per unit time, changes during execution of a respective print job, so as to synchronize heater activation with an initial entry of a recording medium for the respective print job into the fixing nip after a change to the imaging speed.

4. The fixing device according to claim 3, wherein the controller resets the timing of the on-off switching control cycle in a condition in which an expected difference in time between heater activation and a subsequent entry of a recording medium into the fixing nip exceeds 100 milliseconds.

5. The fixing device according to claim 1, wherein the controller adjusts the on-time to maintain a constant duty ratio of the on-time relative to a sum of the on-time and the off-time in the on-off switching control cycle upon a timing reset of the on-off switching control cycle.

6. The fixing device according to claim 1, wherein the controller adjusts at least one of the conveyance speed, the interval distance, the cycle duration, the cycle count, and combinations thereof to keep the equation satisfied.

7. The fixing device according to claim 6, wherein the controller adjusts a combination of the cycle duration and the cycle count to accommodate changes in a length of the recording medium in the conveyance direction.

8. The fixing device according to claim 6, wherein the controller adjusts a combination of the interval distance and the cycle count to accommodate changes in the conveyance speed.

9. The fixing device according to claim 8, wherein the controller performs adjustment for each of the multiple recording media to maintain a constant imaging speed, measured in terms of number of recording media processed per unit time, during execution of a respective print job.

10. The fixing device according to claim 6, wherein the controller adjusts the cycle duration to accommodate changes in the interval distance.

11. The fixing device according to claim 10, wherein the controller performs adjustment where the interval distance changes as an imaging speed, measured in terms of number of recording media processed per unit time, changes during execution of a respective print job.

12. The fixing device according to claim 6, wherein the controller adjusts a combination of the cycle duration and the cycle count to accommodate changes in the interval distance.

13. The fixing device according to claim 12, wherein the controller performs adjustment where the interval distance changes as an imaging speed, measured in terms of number of recording media processed per unit time, changes during execution of a respective print job.

14. The fixing device according to claim 6, wherein the controller adjusts the cycle count to accommodate changes in the interval distance.

15. The fixing device according to claim 14, wherein the controller performs adjustment where the interval distance changes as an imaging speed, measured in terms of number of recording media processed per unit time, changes during execution of a respective print job.

16. The fixing device according to claim 1, further including a thermometer adjacent to the fuser member to measure a temperature of the fuser member, wherein the controller controls power supply to the heater according to the temperature measured by the thermometer.

17. An image forming apparatus incorporating the fixing device according to claim 1.

18. A fixing device comprising:

a rotatable fuser member subjected to heating;

a rotatable pressure member disposed opposite the fuser member, the pressure member pressing against the fuser member to form a fixing nip therebetween, through which multiple recording media, each spaced apart from each other by an interval distance in a conveyance direction, are sequentially conveyed at a conveyance speed;

a heater adjacent to the fuser member to heat the fuser member; and a controller operatively connected to the heater to control a power supply to the heater through a series of on-off switching control cycles, each on-off switching control cycle including an on-time during which the power supply to the heater is on to increase heating of the fuser member, and an off-time during which the power supply to the heater is off, in synchronization with conveyance of the recording medium to satisfy the following equation:

$$T1+T2=C*X$$

where "T1" is a length of media passage time during which each recording medium passes through the fixing nip, "T2" is a length of interval time between two successive recording media exiting and subsequently entering the fixing nip, "C" is a cycle duration of an on-off switching control cycle of the power supply to the heater, and "X" is a cycle count being a positive integer, wherein the controller resets a timing of a series of on-off switching control cycles corresponding to a print job, such that the heater is activated to heat the fuser member simultaneously with entry of each recording medium for the print job into the fixing nip, wherein the controller adjusts at least one of the conveyance speed, the interval distance, the cycle duration, the cycle count, and combinations thereof to keep the equation satisfied, and wherein the controller adjusts a combination of the cycle duration and the cycle count to accommodate changes in the conveyance speed.

19. A fixing device comprising:

a rotatable fuser member subjected to heating;

a rotatable pressure member disposed opposite the fuser member, the pressure member pressing against the fuser member to form a fixing nip therebetween, through which multiple recording media, each spaced apart from each other by an interval distance in a conveyance direction, are sequentially conveyed at a conveyance speed;

a heater adjacent to the fuser member to heat the fuser member; and a controller operatively connected to the heater to control a power supply to the heater through a series of on-off switching control cycles, each on-off switching control cycle including an on-time during which the power supply to the heater is on, and an off-time during which the power supply to the heater is off, in synchronization with conveyance of the recording medium to satisfy the following equation:

$$T1+T2=C*X$$

where "T1" is a length of media passage time during which each recording medium passes through the fixing nip, "T2" is a length of interval time between two successive recording media exiting and subsequently entering the fixing nip, "C" is a cycle duration of an on-off switching control cycle of the power supply to the heater, and "X" is a cycle count being a positive integer, wherein the controller resets a timing of at least one of the series of on-off switching control cycles, such that the heater is activated simultaneously with entry of the recording medium into the fixing nip, and wherein the controller resets a timing of the on-off switching control cycle where an imaging speed, measured in terms of number of recording media processed per unit time, changes during execution of a print job, so as to synchronize heater activation with an initial entry of a recording medium for the print job into the fixing nip after a change to the imaging speed.

20. A fixing device comprising:

a rotatable fuser member subjected to heating;

a rotatable pressure member disposed opposite the fuser member, the pressure member pressing against the fuser member to form a fixing nip therebetween, through which multiple recording media, each spaced apart from each other by an interval distance in a conveyance direction, are sequentially conveyed at a conveyance speed;

a heater adjacent to the fuser member to heat the fuser member; and a controller operatively connected to the heater to control a power supply to at least a portion of the heater corresponding to a portion of the fuser member that contacts the multiple recording media through a series of on-off switching control cycles, each on-off switching control cycle including an on-time during which the power supply to the portion of the heater is on to increase heating of the portion of the fuser member, and an off-time during which the power supply to the portion of the heater is off, in synchronization with conveyance of the recording medium to satisfy the following equation:

$$T1+T2=C*X$$

where "T1" is a length of media passage time during which each recording medium passes through the fixing nip, "T2" is a length of interval time between two successive recording media exiting and subsequently entering the fixing nip, "C" is a cycle duration of an on-off switching control cycle of the power supply to the heater and "X" is a cycle count being a positive integer, wherein during an execution of a sequential image formation job to sequentially form images on plural recording media of the multiple recording media, the controller controls the power supply to activate the heater an identical number of times for each recording medium of the plural recording media and have the same time length of the on-time of the on-off switching control cycle for all of the plural recording media on which the sequential image formation job is executed.

21. The fixing device according to claim 20, wherein the controller synchronizes a start of a cycle duration of each of a series of on-off switching control cycles corresponding a to the sequential image formation job with entry of each recording medium of the plural recording media into the fixing nip.

22. The fixing device according to claim 20, wherein the heater comprises a halogen heater.

23. An image forming apparatus, comprising the fixing device according to claim 20.

* * * * *